US011830397B2

(12) United States Patent
Ahn et al.

(10) Patent No.: US 11,830,397 B2
(45) Date of Patent: Nov. 28, 2023

(54) STRETCHABLE DISPLAY BASED ON 3 DIMENSIONAL STRUCTURE AND MANUFACTURING METHOD THEREOF

(71) Applicant: UIF (University Industry Foundation), Yonsei University, Seoul (KR)

(72) Inventors: Jong-Hyun Ahn, Seoul (KR); Yongjun Lee, Seoul (KR); Beom Jin Kim, Seoul (KR); Luhing Hu, Seoul (KR); Juyeong Hong, Seoul (KR)

(73) Assignee: UIF (University Industry Foundation), Yonsei University, Seoul (KR)

( * ) Notice: Subject to any disclaimer, the term of this patent is extended or adjusted under 35 U.S.C. 154(b) by 0 days.

(21) Appl. No.: 18/169,483

(22) Filed: Feb. 15, 2023

(65) Prior Publication Data

US 2023/0260438 A1 Aug. 17, 2023

(30) Foreign Application Priority Data

Feb. 16, 2022 (KR) ..... 10-2022-0020353

(51) Int. Cl.
*G09G 3/00* (2006.01)

(52) U.S. Cl.
CPC ..... *G09G 3/035* (2020.08); *G09G 2300/0465* (2013.01); *G09G 2340/0407* (2013.01)

(58) Field of Classification Search
CPC ..... G09G 3/035; G09G 2300/0465; G09G 2340/0407
See application file for complete search history.

(56) References Cited

U.S. PATENT DOCUMENTS

2016/0136877 A1* 5/2016 Rogers ..... B29C 61/0616 156/163
2021/0175435 A1* 6/2021 Kadoma ..... C09K 11/06

FOREIGN PATENT DOCUMENTS

KR 10-2016-0113872 A 10/2016
KR 10-1902380 B1 10/2018
KR 10-1937369 B1 4/2019

OTHER PUBLICATIONS

Lee, Yongjun et al. "Morphable 3D structure for stretchable display." Research Paper. School of Electrical and Electronic Engineering, Yonsei University, Seoul 03722, Republic of Korea. Mar. 2022. <https://doi.org/10.1016/j.mattod.2022.01.017>.

* cited by examiner

*Primary Examiner* — Robert J Michaud
(74) *Attorney, Agent, or Firm* — BROADVIEW IP LAW, PC

(57) ABSTRACT

The present exemplary embodiments provide a stretchable display which controls an appropriate resolution by disposing a hidden cell below a layer in which an open cell is located using a morphable three-dimensional structure in which LED chips are vertically disposed, rather than a two-dimensional platform of the existing plane, sensing a current change in accordance with a mode switching between a folded mode and a stretched mode while maintaining a state in which an open cell is exposed and the hidden cell is hidden in a folded mode, to automatically turn on/off the hidden cell, and activating the hidden cell in the stretched mode and a manufacturing method thereof.

17 Claims, 26 Drawing Sheets

(a) (b)

STRETCHABLE DISPLAY BASED ON 3 DIMENSIONAL STRUCTURE AND MANUFACTURING METHOD THEREOF

CROSS-REFERENCE TO RELATED APPLICATIONS

This application claims priority to and the benefit of Korean Patent Application No. 10-2022-0020353 filed in the Korean Intellectual Property Office on Feb. 16, 2022, the entire contents of which are incorporated herein by reference.

BACKGROUND

Field

A technical field of the present disclosure relates to a stretchable display and a manufacturing method thereof. The present patent application has been filed as research projects as described below.

National Research Development Project supporting the Present Invention
Project Serial No. 1711130683
Project No.: 2015R1A3A2066337
Department: Ministry of Science and ICT
Project management (Professional) Institute: The National Research Foundation of Korea
Research Project Name: Leader Grants
Research Task Name: Center for strain engineered electronic devices (¼, third step)
Contribution Ratio: 1/1
Project Performing Institution: UIF (University Industry Foundation), Yonsei University
Research Period: Apr. 1, 2021~Feb. 28, 2022

Description of the Related Art

The contents described in this section merely provide background information on the present exemplary embodiment but do not constitute the related art.

Recently, in accordance with the development of a display related technique, transformable display devices which are bendable, rollable, or are stretchable in at least one direction are being studied and developed.

According to a method which forms a flat pattern stretchable between cells on a substrate among display devices which are transformable during a usage step, as the flat pattern is stretched, a distance between cells is increased and a resolution is degraded. Here, the resolution refers to a number of pixels according to a unit area and a quality of an image provided after stretching the display is inferior to the quality of the image provided before stretching the display.

RELATED ART DOCUMENT

Patent Document (Patent Document 1) Korean Unexamined Patent Application Publication No. 10-2016-0113872 (Oct. 4, 2016)
(Patent Document 2) Korean Registered Patent Publication No. 10-1937369 (Jan. 4, 2019)

SUMMARY

A main object of exemplary embodiments of the present disclosure is to control an appropriate resolution by disposing a hidden cell below a layer in which an open cell is located using a morphable three-dimensional structure in which LED chips are vertically disposed, rather than a two-dimensional flat platform of the related art, and sensing a current change in accordance with a mode switching between a folded mode and a stretched mode while maintaining a state in which an open cell is exposed and the hidden cell is hidden in a folded mode, to automatically turn on/off the hidden cell, and activating the hidden cell in the stretched mode.

Other and further objects of the present disclosure which are not specifically described can be further considered within the scope easily deduced from the following detailed description and the effect.

According to an aspect of the present embodiment, a stretchable display which operates in a first display mode or a second display mode includes a substrate which is patterned according to a foldable design and has a pixel array disposed thereon; a wiring electrode connected to the pixel array; a protecting unit which includes a carbon polymer compound formed on the wiring electrode; a black matrix which is formed in the protecting unit and processes light; a thickness adjusting unit which is formed in the black matrix and has a part folded in the second display mode thinner than a part which is not folded; and an elastomer attached to the substrate.

The stretchable display is a flat structure state in the first display mode and is a folded structure state in the second display mode.

The substrate includes a donut blank structure and a cross connection structure through which a wiring path passes in a polygonal shape, a circular shape, or a combination thereof according to the design and The substrate is divided into (i) an open area which is exposed in the first display mode or the second display mode and (ii) a hidden area exposed only in the first display mode.

The pixel array includes an open pixel located in the open area and includes a hidden pixel located in the hidden area, the open pixel is activated in the first display mode or the second display mode, and the hidden pixel is activated only in the first display mode.

The stretchable display activates the hidden pixels as much as a ratio of the increased area in the first display mode from the second display mode to adjust a resolution per unit area.

The stretchable display further includes a current measuring unit which measures a first current value through the wiring electrode in the flat structure state of the first display mode and measures a second current value measured through the wiring electrode in the folded structure state of the second display mode.

The stretchable display further includes a controller which transmits (i) a first on-off control signal generated based on a result of comparing the first current value and the reference current value, (ii) a second on-off control signal generated based on a result of comparing the second current value and the reference current value, or a third on-off control signal which is a combination of the first on-off control signal and the second on-off control signal to the hidden pixel.

The hidden pixel is turned on or turned off according to the first on-off control signal, the second on-off control signal, or the third on-off control signal.

The stretchable display is changed between the first display mode, the second display mode, and the third display mode and The substrate is divided into (i) an open area which is exposed in the first display mode, the second display mode, and the third display mode, (ii) a second hidden area which is exposed in the first display mode and the second display mode, and (iii) a first hidden area which is exposed only in the first display mode.

The pixel array includes an open pixel located in the open area, a first hidden pixel located in the first hidden area, and a second hidden pixel located in the second hidden area. The open pixel is activated in the first display mode, the second display mode, or the third display mode, the first hidden pixel is activated only in the first display mode, and the second hidden pixel is activated in the first display mode or the second display mode.

According to another aspect of the present embodiment, a manufacturing method of a stretchable display manufacturing method includes: preparing a substrate on which a pixel array is disposed; forming a flat structure which operates in a first display mode by patterning the substrate on which the pixel array is disposed according to a foldable design and connecting a wiring electrode; and forming a folded structure operating in a second display mode by attaching an elastomer to the flat structure.

The foldable design includes a donut blank structure and a cross connection structure through which a wiring path passes in a polygonal shape, a circular shape, or a combination thereof and the substrate is divided into an open area and a hidden area.

The forming of a flat structure includes: connecting the wiring electrode to the pixel array.

The forming of a flat structure includes: forming a protecting unit including a carbon polymer compound in the wiring electrode.

The forming of a flat structure includes: forming a black matrix which treats light on the protecting unit.

The forming of a flat structure includes forming a thickness adjusting unit in which a folded portion in the second display mode is formed to be thinner than the unfolded portion, in the black matrix.

The forming of a flat structure includes: forming a contact prevention unit so as not to be attached to the elastomer, in the thickness adjusting unit.

The forming of a folded structure includes: attaching a water soluble tape to a flat structure including the contact prevention unit; and subjecting a ultraviolet ozone (UVO) treatment to a surface of the flat structure and a surface of the elastomer.

The forming of a folded structure includes: stretching a surface-treated elastomer to a predetermined size; and forming a sandwich structure in which the flat structure is located between the water soluble tape and the elastomer, by attaching the stretched elastomer to the surface-treated flat structure.

The forming of a folded structure includes: removing the water soluble tape and removing the contact prevention unit; and changing the flat structure to the folded structure by contacting the stretched elastomer to an original size.

As described above, according to the exemplary embodiments of the present disclosure, a current change is sensed in accordance with a mode switching between a folded mode and an stretched mode while maintaining a state in which an open cell is exposed and the hidden cell is hidden in a folded mode to automatically turn on/turn off the hidden cell and the hidden cell is activated in the stretched mode to control an appropriate resolution and the resolution is maintained in the same or predetermined range even with the increased area.

Even if the effects are not explicitly mentioned here, the effects described in the following specification which are expected by the technical features of the present disclosure and their potential effects are handled as described in the specification of the present disclosure.

DETAILED DESCRIPTION OF THE EMBODIMENT

Hereinafter, in the description of the present disclosure, a detailed description of the related known functions will be omitted if it is determined that the gist of the present disclosure may be unnecessarily blurred as it is obvious to those skilled in the art and some exemplary embodiments of the present disclosure will be described in detail with reference to exemplary drawings.

A device with a three-dimensional structure having an elastomer as a substrate has stretchability to be stretched and unstretched by an external force.

The exemplary embodiment relates to a display device which maintains a resolution using a property of the elastomer even in an stretched state and a manufacturing technique thereof.

A display device is manufactured on a wafer substrate and a three-dimensional structure is formed using a material which can adjust a thickness and use a photolithography technique. In order to form the three-dimensional structure, a portion to be folded and a portion which is not folded are configured by adjusting the thickness.

In a folded state (a second display mode) of a display having a three-dimensional structure, a hidden cell (hidden pixel) and a turned-on cell are simultaneously included and in the stretched state (a first display mode), the hidden pixel is turned on to maintain the existing resolution.

The hidden pixel of the three-dimensional display is implemented to be automatically turned on or turned off. There is a difference in current according to an applied voltage in a three-dimensional folded structure before stretching and a flat structure after stretching and a feedback method using this difference is used. The hidden pixel is turned on or turned off based on the measured specific current value.

According to the hidden pixel method applying the three-dimensional structure, the hidden pixel is not disposed on the same plane so that the initial resolution is not limited and even though it is stretched, the initial resolution may be maintained.

Figure 1:
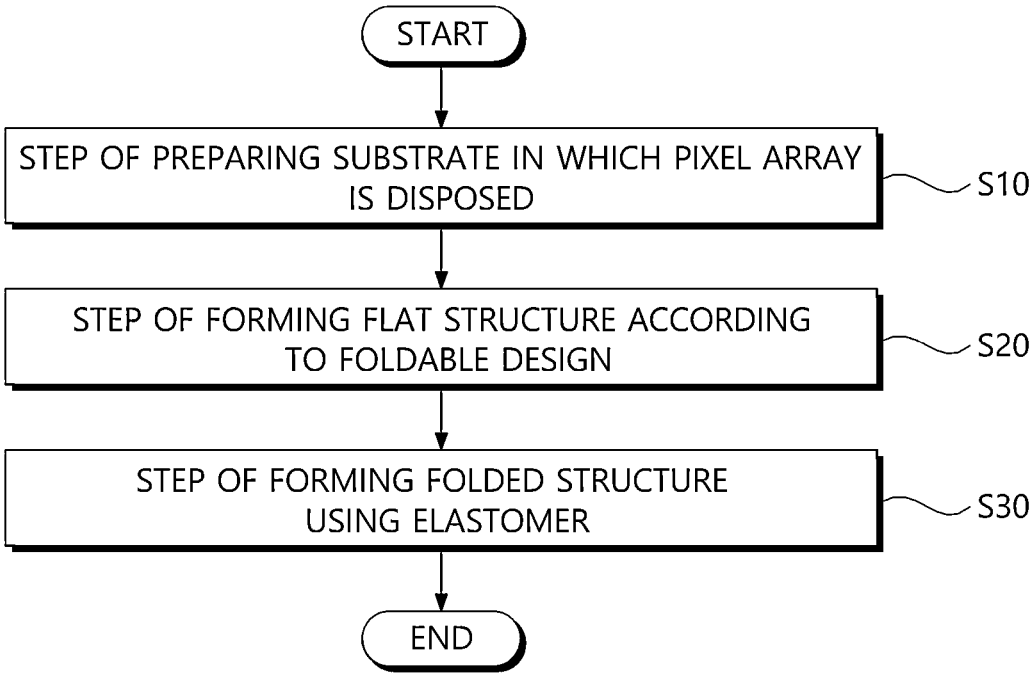
FIG. 1 is a flowchart illustrating a manufacturing method of a stretchable display according to an exemplary embodiment of the present disclosure.

FIG. 1 is a flowchart illustrating a manufacturing method of a stretchable display according to an exemplary embodiment of the present disclosure.

The stretchable display manufacturing method includes: a step S10 of preparing a substrate on which a pixel array is disposed, a step S20 of forming a flat structure which operates in a first display mode by patterning the substrate on which the pixel array is disposed according to a foldable design and connecting a wiring electrode, and a step S30 of forming a folded structure which operates in a second display mode by attaching an elastomer to the flat structure.

Figure 2:
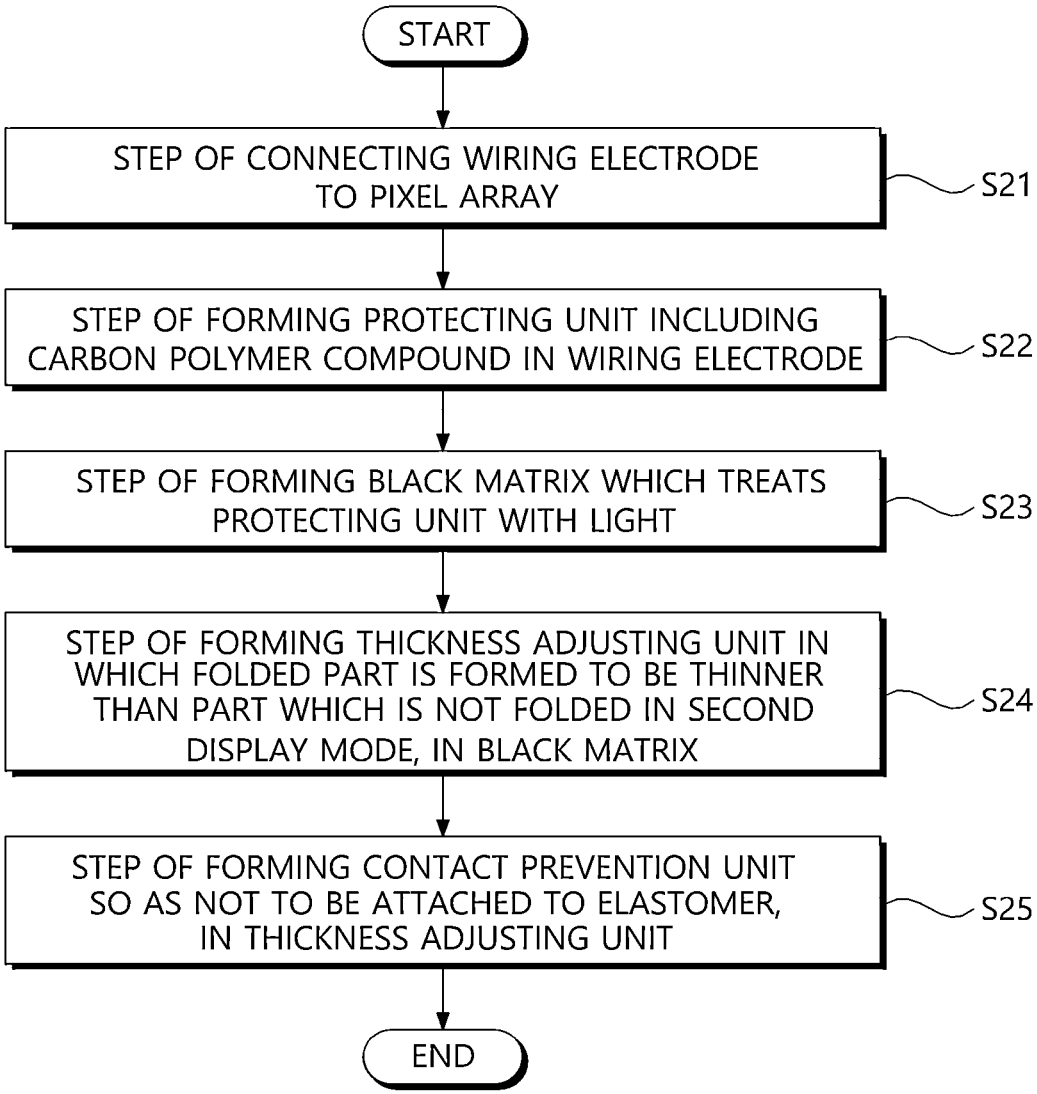
FIG. 2 is a flowchart illustrating a step of forming a flat structure in a manufacturing method of a stretchable display according to an exemplary embodiment of the present disclosure.

FIG. 2 is a flowchart illustrating a step of forming a flat structure in a manufacturing method of a stretchable display according to an exemplary embodiment of the present disclosure.

The step S20 of forming a flat structure includes a step S21 of connecting a wiring electrode to the pixel array.

The step S20 of forming a flat structure includes a step S22 of forming a protecting unit including a carbon polymer compound in the wiring electrode. The protecting unit may cover a part or all of the wiring electrode or cover a part of the other configuration.

The step S20 of forming a flat structure includes a step S23 of forming a black matrix which processes light in the protecting unit. The black matrix may cover a part or all of the protecting unit or cover a part of the other configuration.

The step S20 of forming a flat structure includes a step S24 of forming a thickness adjusting unit in which a folded portion in the second display mode is formed to be thinner than the unfolded portion, in the black matrix. The thickness adjusting unit may cover a part or all of the black matrix or cover a part of the other configuration.

The step S20 of forming a flat structure includes a step S25 of forming a contact preventing unit in the thickness adjusting unit so as not to be attached to the elastomer. The contact preventing unit may cover a part or all of the thickness adjusting unit or cover a part of the other configuration.

Figure 3:
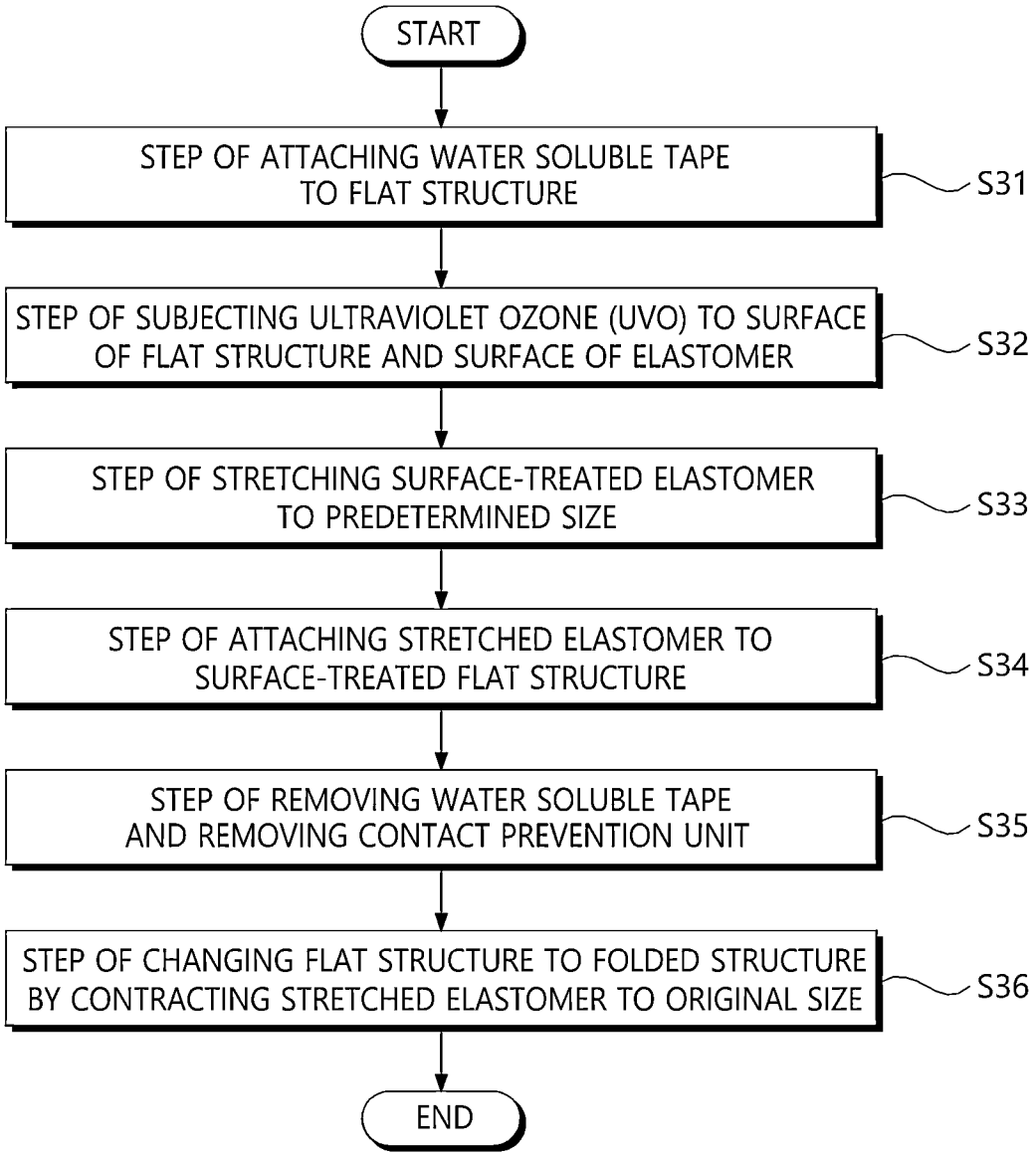
FIG. 3 is a flowchart illustrating a step of forming a folded structure in a manufacturing method of a stretchable display according to an exemplary embodiment of the present disclosure.

FIG. 3 is a flowchart illustrating a step of forming a folded structure in a manufacturing method of a stretchable display according to an exemplary embodiment of the present disclosure.

The step S30 of forming a folded structure includes a step S31 of attaching a water soluble tape to the flat structure including the contact preventing unit.

The step S30 of forming a folded structure includes a step S32 of subjecting ultraviolet ozone (UVO) treatment to a surface of the flat structure and a surface of the elastomer.

The step S30 of forming a folded structure includes a step S33 of stretching a surface-treated elastomer to a predetermined size.

The step S30 of forming a folded structure includes a step S34 of forming a sandwich structure by bonding the stretched elastomer to the surface-treated flat structure so that the flat structure is located between the water soluble tape and the elastomer.

The step S30 of forming a folded structure includes a step S35 of removing the water soluble tape and removing the contact preventing unit.

The step S30 of forming a folded structure includes a step S36 of contracting the stretched elastomer to its original size to change the flat structure to a folded structure.

Figure 4:
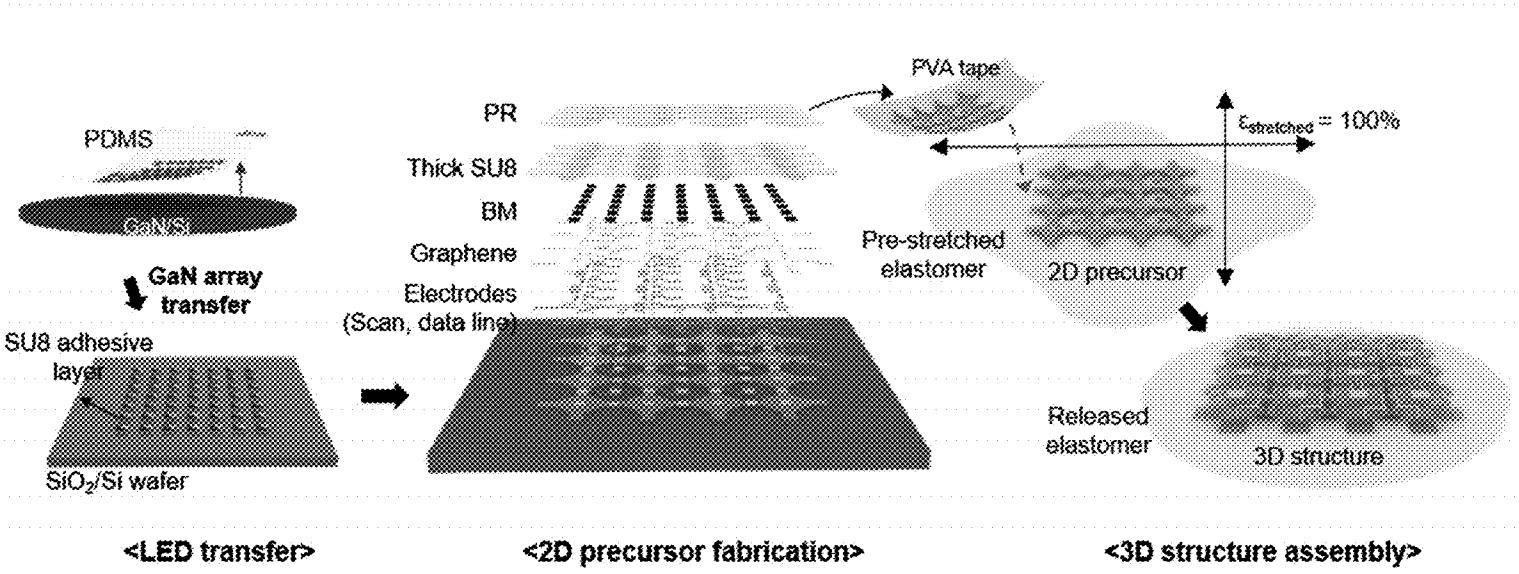
FIG. 4 is a view illustrating a manufacturing method of a stretchable display according to an exemplary embodiment of the present disclosure.

FIG. 4 is a view illustrating a manufacturing method of a stretchable display according to an exemplary embodiment of the present disclosure. The material illustrated in FIG. 4 may be replaced with another material having a similar property.

An inorganic LED (GaN or GaAs) is separated from a mother board to be transferred onto a handling substrate. A two-dimensional precursor design and wiring lines which become a three-dimensional structure as a final target are configured on the handling substrate. The foldable design may include a donut blank structure and a cross connection structure through which a wiring path passes in a polygonal shape, a circular shape, or a combination thereof. The substrate is divided into an open area and a hidden area.

A thickness is adjusted according to a position of a display device which is formed of a material on which the photolithography can be performed, such as SUB. A part (hinge) which needs to be folded is thinner than a part which is not folded so that when a strain is applied thereto, the part to be folded is folded.

When it is attached to the elastomer, a part which is not finally attached to the elastomer is blocked by a photoresist PR and is finally removed to form a three-dimensional structure.

After manufacturing the display device on a $Si/SiO_2$ wafer, $SiO_2$ is removed using buffered oxide etch (BOE) and an HF material. The device is detached from the wafer using a PDMS stamp to be transferred onto the PDMS.

A water soluble tape such as a PVA tape is attached onto the PDMS/device and then detached to transfer the device onto the PVA tape.

The UVO treatment is subjected to the surface of the transferred PVD tape/device and the surface of the elastomer to increase a surface attachment energy. Thereafter, the elastomer is stretched and the PVA tape/device is attached onto the stretched elastomer.

The PVD tape is removed using water and a designated PR is removed so as not to be attached to the elastomer. The stretched elastomer returns to its original state. At this time, a shape of the 3D structure is formed based on the folded structure of the thickness adjusting unit according to a design, by the contraction of the elastomer.

Figure 5:
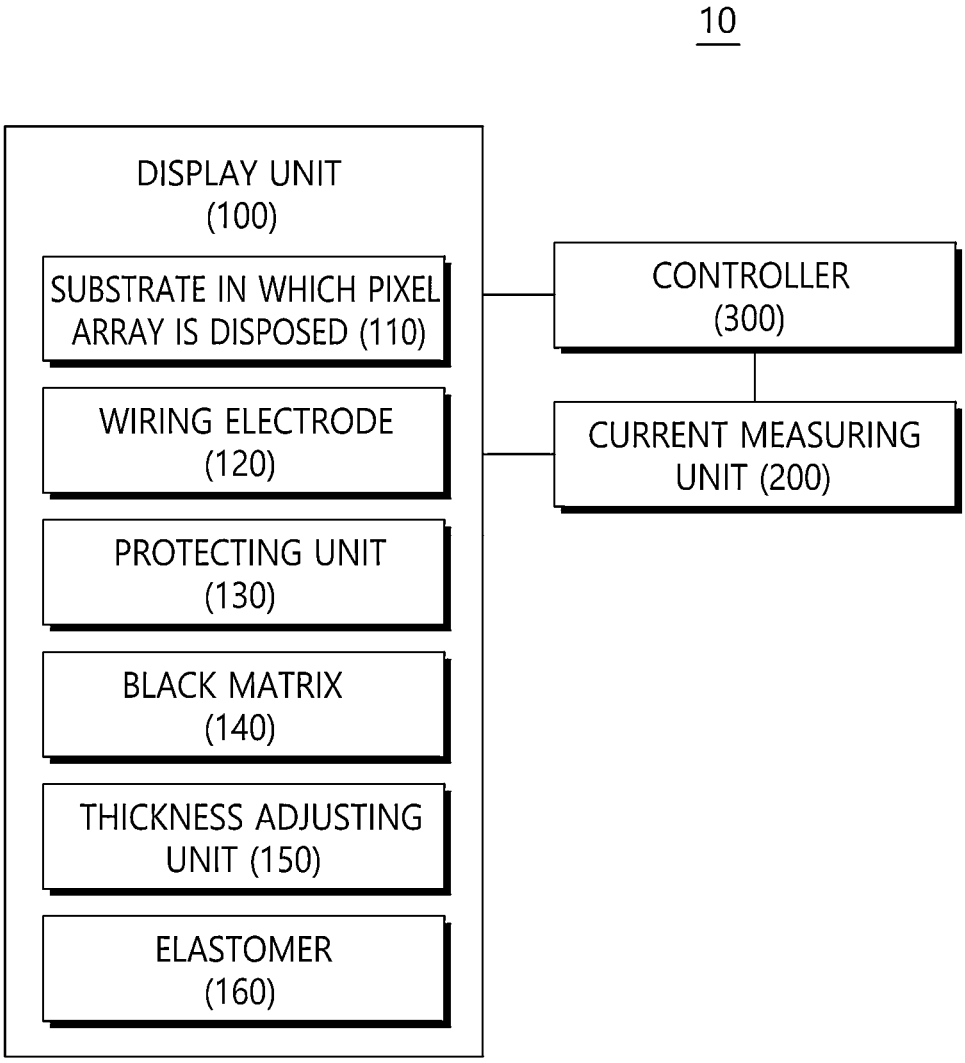
FIG. 5 is a view illustrating a stretchable display according to another exemplary embodiment of the present disclosure.

FIG. 5 is a view illustrating a stretchable display according to another exemplary embodiment of the present disclosure.

The stretchable display 10 operates in a first display mode (stretched mode) or a second display mode (folded mode). The stretchable display is a flat structure state in the first display mode (stretched mode) and is a folded structure state in the second display mode (folded mode).

The stretchable display 10 includes a display unit 100, a current measuring unit 200, and a controller 300.

The display unit 100 includes a substrate 110 on which a pixel array is disposed, a wiring electrode 120, a protecting unit 130, a black matrix 140, a thickness adjusting unit 150, and an elastomer 160.

The substrate 110 on which the pixel array is disposed is patterned according to the foldable design. The foldable design may include a donut blank structure and a cross connection structure through which a wiring path passes in a polygonal shape, a circular shape, or a combination thereof.

The substrate includes a donut blank structure and a cross connection structure through which a wiring path passes in a polygonal shape, a circular shape, or a combination thereof according to the design. The substrate is divided into an open area and a hidden area. The open area is exposed in the first display mode or the second display mode and the hidden area is exposed only in the first display mode.

The pixel array includes an open pixel located in the open area and includes a hidden pixel located in the hidden area. The open pixel is activated in the first display mode or the second display mode and the hidden pixel is activated only in the first display mode.

The wiring electrode 120 is connected to the pixel array. The wiring electrode 120 includes a scan line and a data line.

The protecting unit 130 is formed on the wiring electrode and includes a carbon polymer compound. An example of the carbon polymer compound includes graphene.

The black matrix 140 is formed on the protecting unit and processes the light and serves to block or absorb light.

The thickness adjusting unit 150 is formed on the black matrix and is formed such that a part which is folded in the second display mode is formed to be thinner than a part which is not folded. The thickness adjusting unit 150 includes a joint structure such as a groove or a hinge. As the thickness adjusting unit, a material in which the photolithography is possible may be applied. As the material in which the photolithography is possible, a positive material in which a part exposed to light disappears and a negative material in which the exposed part remains are applicable, and for example, a SU8 may be applied.

The elastomer 160 is attached to the substrate.

Figure 6:
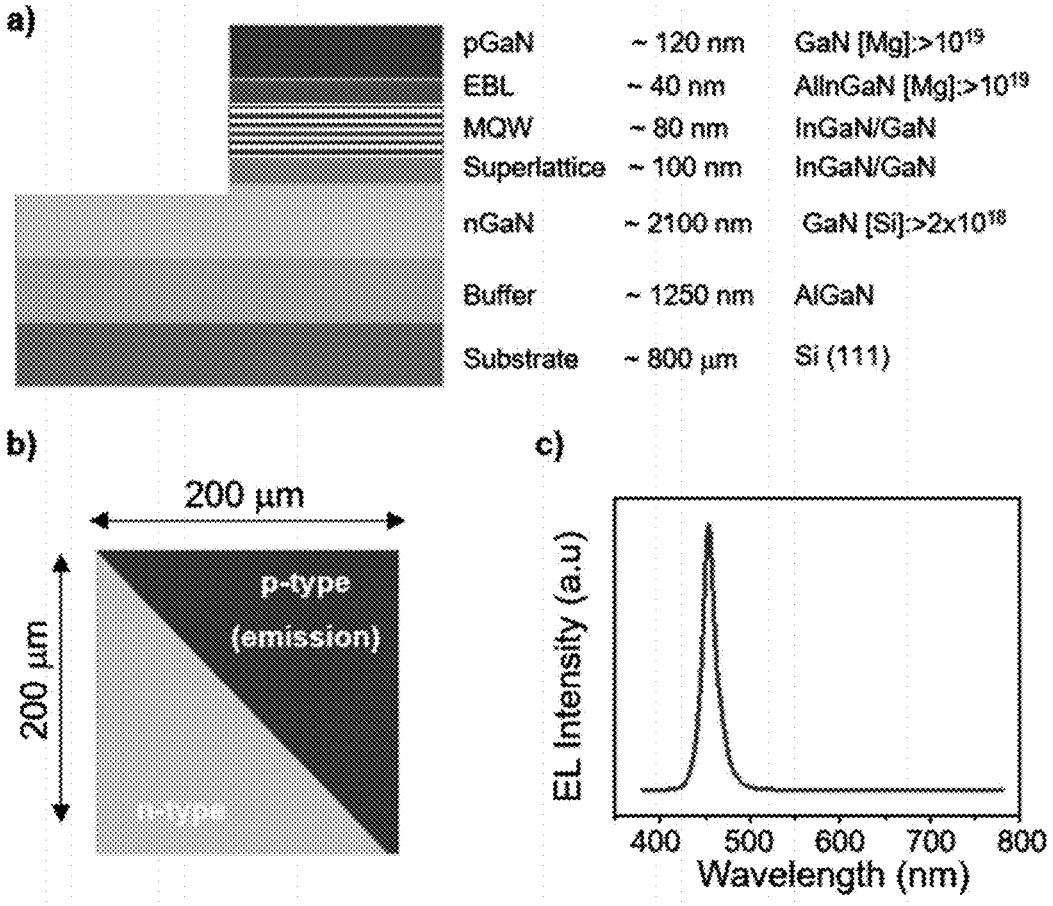
FIG. 6 is a view illustrating a layer structure, a size, and an optical property of GaN LED which is applicable to a stretchable display according to another exemplary embodiment of the present disclosure.

FIG. 6 is a view illustrating a layer structure, a size, and an optical property of GaN LED which is applicable to a stretchable display according to another exemplary embodiment of the present disclosure.

An LED (for example, 200 μm×200 μm) having one pair of support anchors is set on a GaN-on-Si epitaxial wafer. An Si substrate is etched for one hour by immersing the patterned GaN wafer into a potassium hydroxide (KOH) solution. Next, a GaN wafer having a floating GaN LED is cleaned by rising with deionized (DI) water. The polydimethylsiloxane (PDMS) stamp is used to lift the GaN LED array from the GaN wafer. A $SiO_2/Si$ wafer coated with a half soft baked (65° C. for two minutes, 100° C. for 30 seconds) SU8 layer (500 nm) is prepared. Next, the PDMS stamp having an LED array is attached to the prepared $SU8/SiO_2/Si$ wafer. The PDMS/GaN LED/$SU8/SiO_2/Si$ wafer is heated in a hot plate for two minutes at 100° C. Finally, the PDMS stamp is removed to generate the GaN LED on the wafer.

As another method, a patterned GaN is performed on the GaN-on-sapphire wafer. A polymer (for example, SU8, polyimide) having a viscosity which is not cured is coated on the $SiO_2/Si$ and is attached to the patterned GaN surface. Next, the laser lift off (LLO) process is performed by irradiating a laser onto the sapphire surface using an excimer laser (for example, KrF or KeCl) to transfer the GaN LED.

The GaN LED transferring process is just an example, and according to a necessary design, modification, substitution, and application of the order and a numerical value may be possible. As the LED, GaAS, AlGaAS, GaASP, GaP, AlGaInP, and InGaN may be applied, but is not limited thereto and a material having a similar property may be applied.

Figure 7:
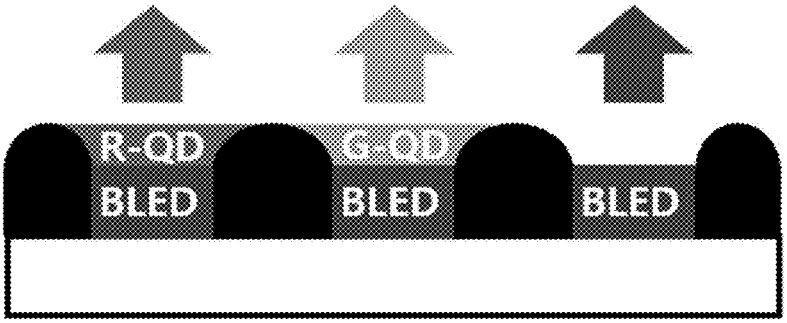
FIG. 7 is a view illustrating color implementation of a stretchable display according to another exemplary embodiment of the present disclosure.

FIG. 7 is a view illustrating color implementation of a stretchable display according to another exemplary embodiment of the present disclosure.

A light source of the LED of the GaN-LED (short wavelength) and an upper color conversion layer are used to expand to the RGB full color display.

RGB three primary colors can be implemented by converting an LED which emits light in the blue/UV range into target light by absorbing energy from the color conversion layer (for example, a quantum dot).

Figure 8:
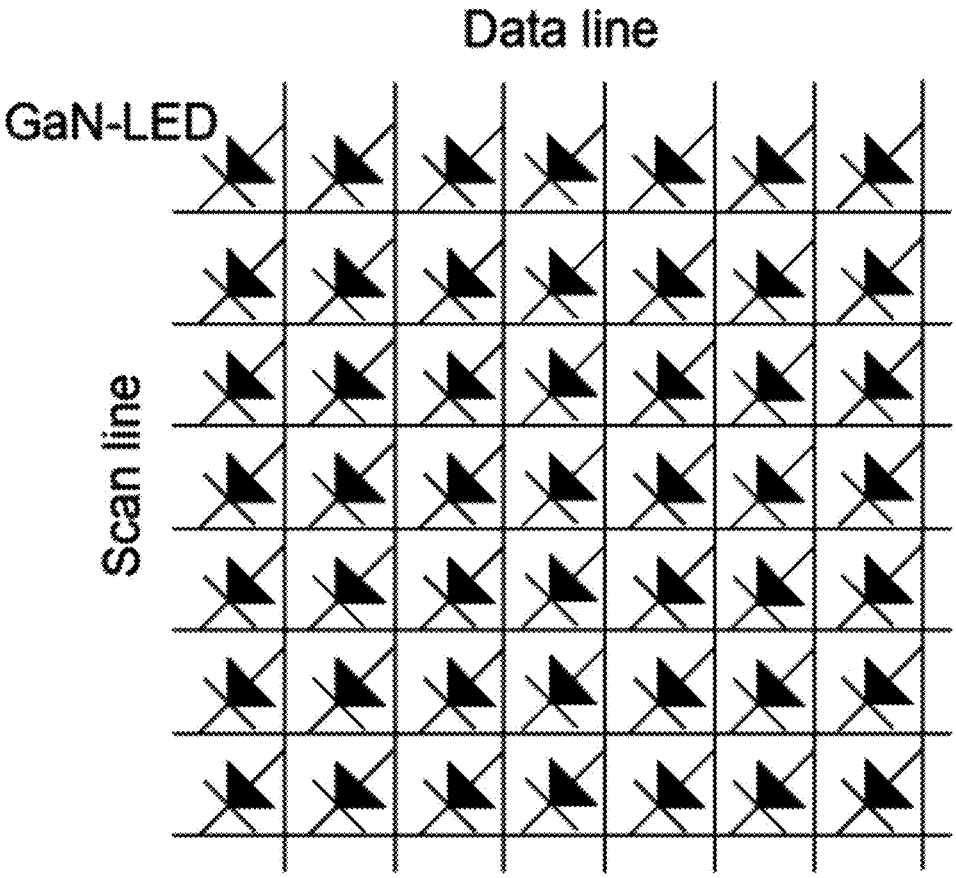
FIGS. 8 to 10 are views illustrating a pixel and a wiring path of a stretchable display according to another exemplary embodiment of the present disclosure.
Figure 9:
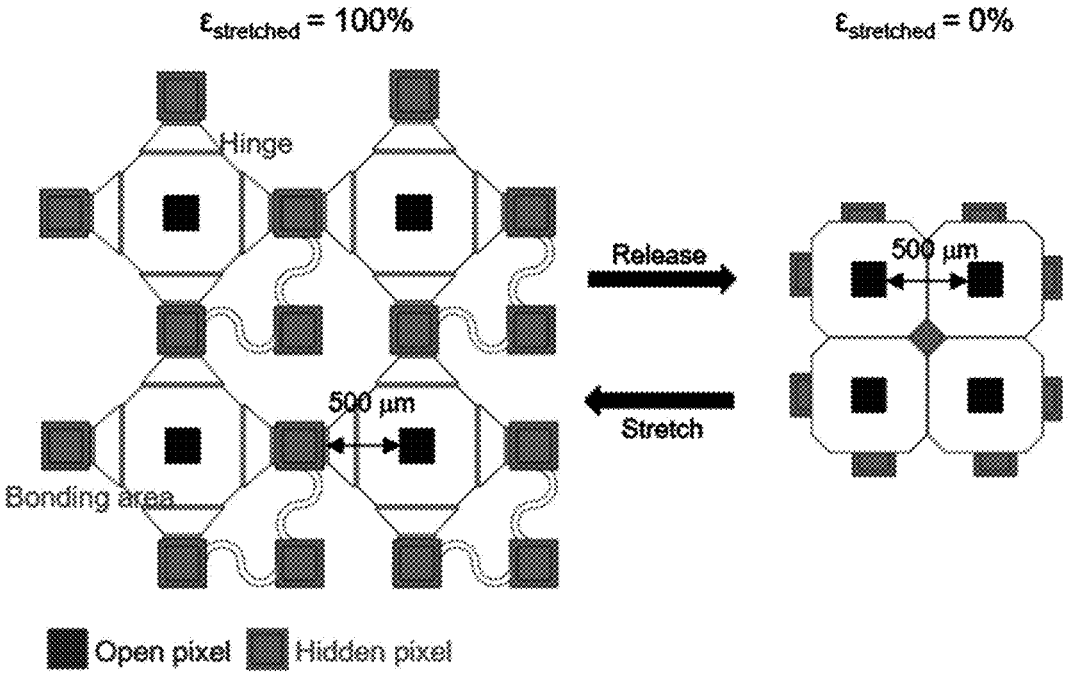
Figure 10:
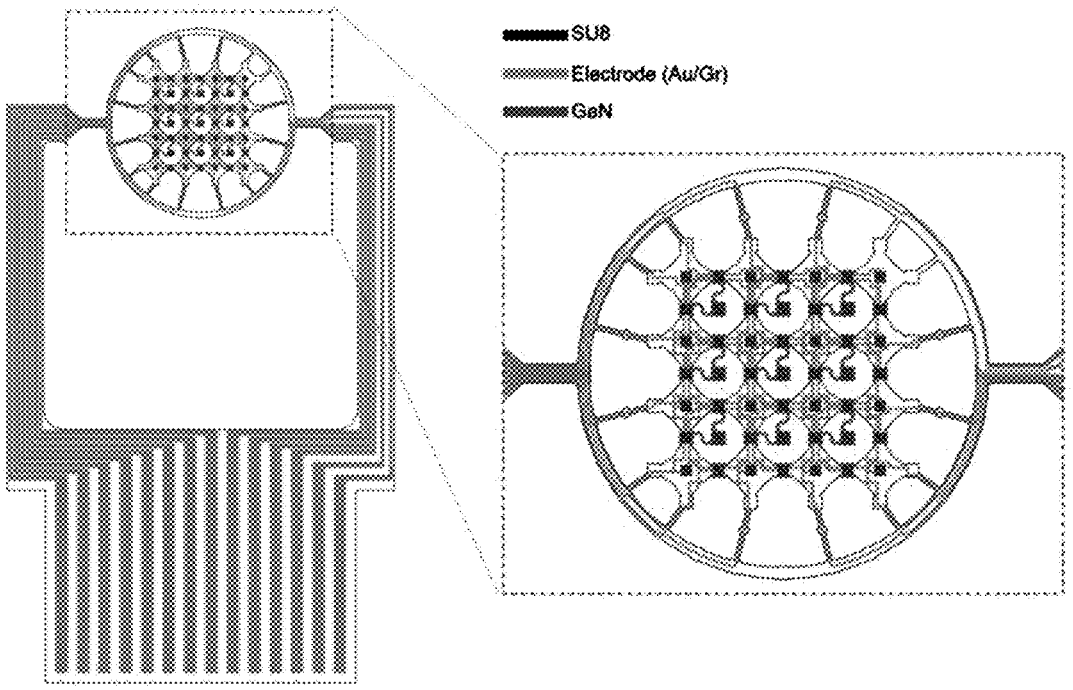

FIGS. 8 to 10 are views illustrating a pixel and a wiring path of a stretchable display according to another exemplary embodiment of the present disclosure.

A wiring path connected to the pixel in the flat structure is designed in consideration of a three-dimensional structure to be modified from the flat structure.

Figure 11:
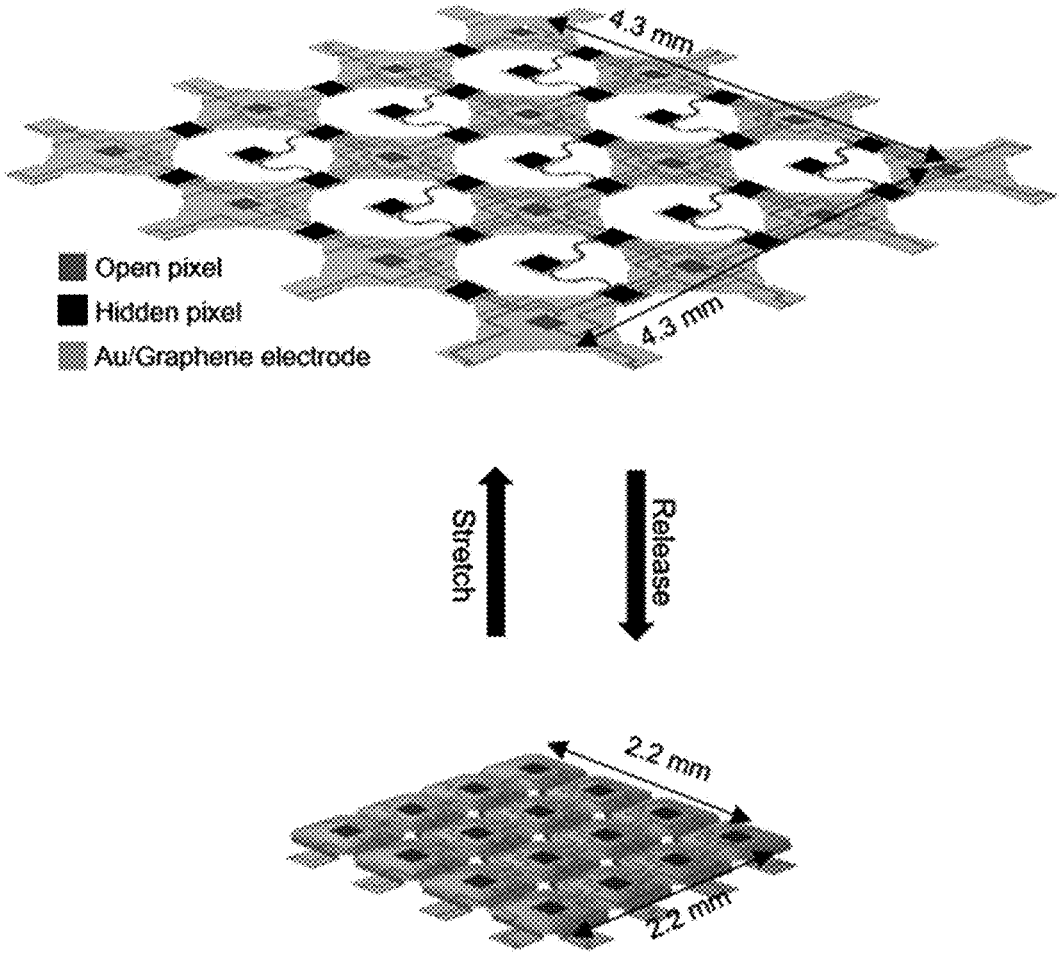
FIGS. 11 and 12 are views illustrating a two-stage structure of a stretchable display according to another exemplary embodiment of the present disclosure.
Figure 12:
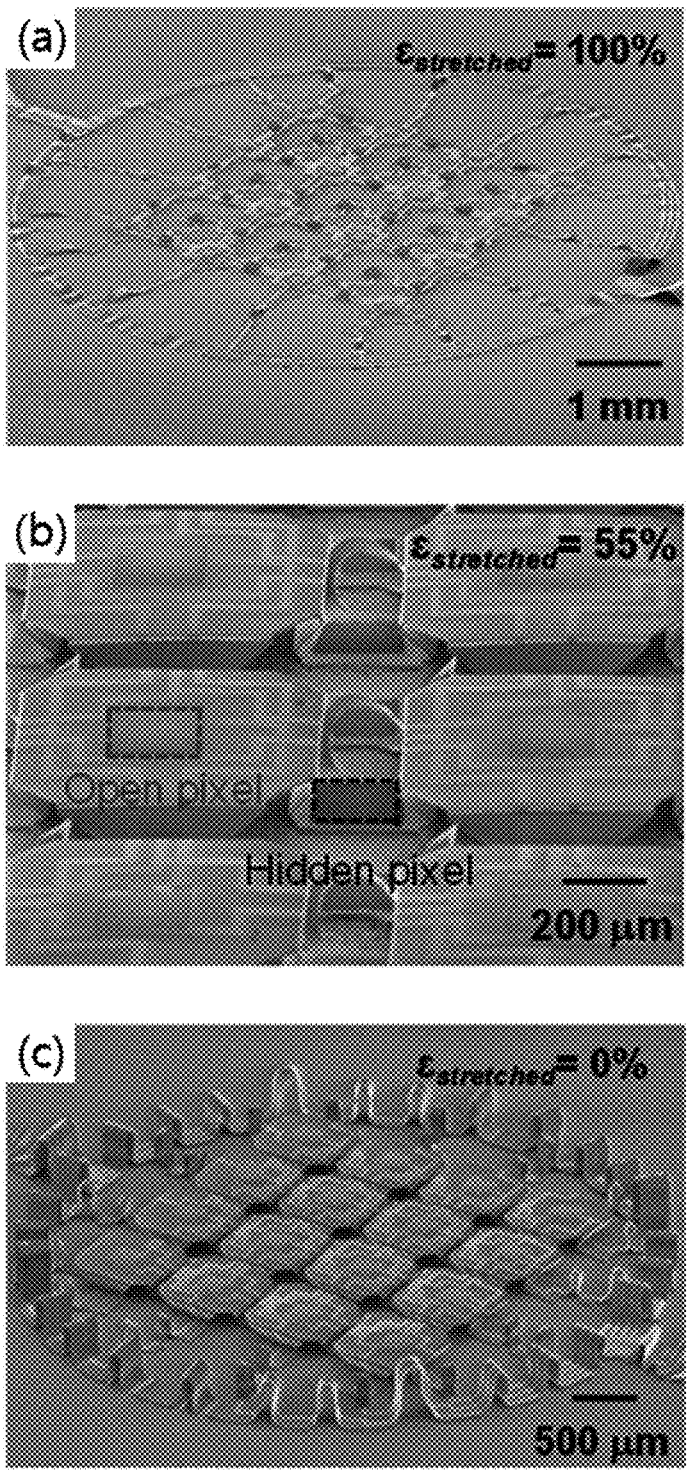
Figure 13:
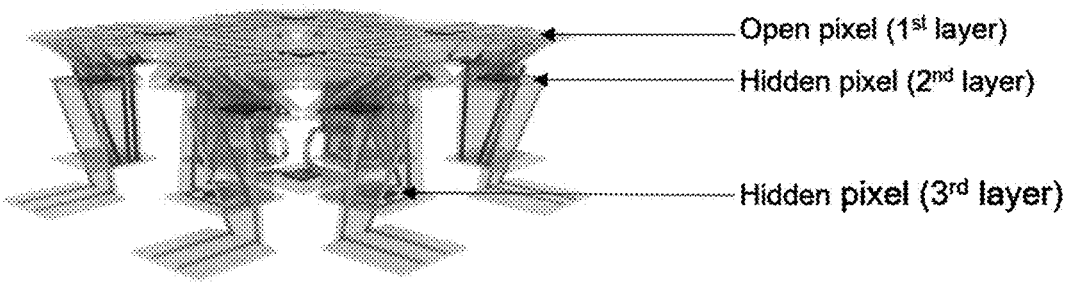
FIGS. 13 and 14 are views illustrating a three-stage structure of a stretchable display according to another exemplary embodiment of the present disclosure.
Figure 14:
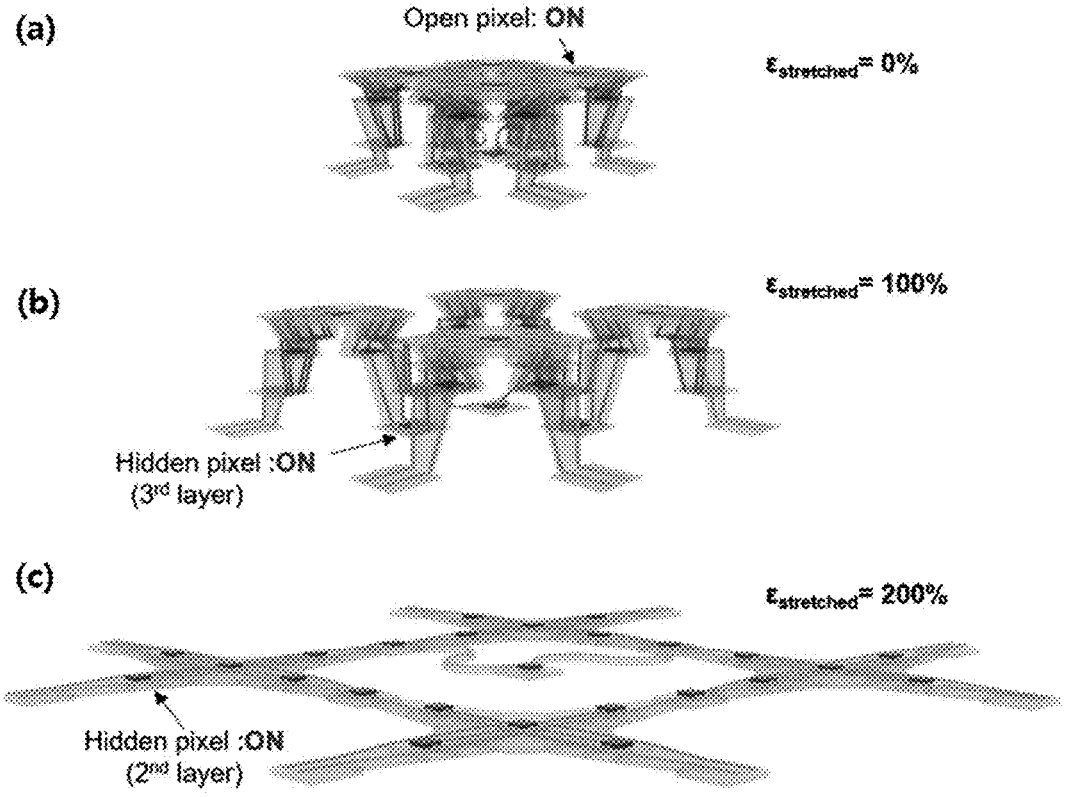
Figure 15:
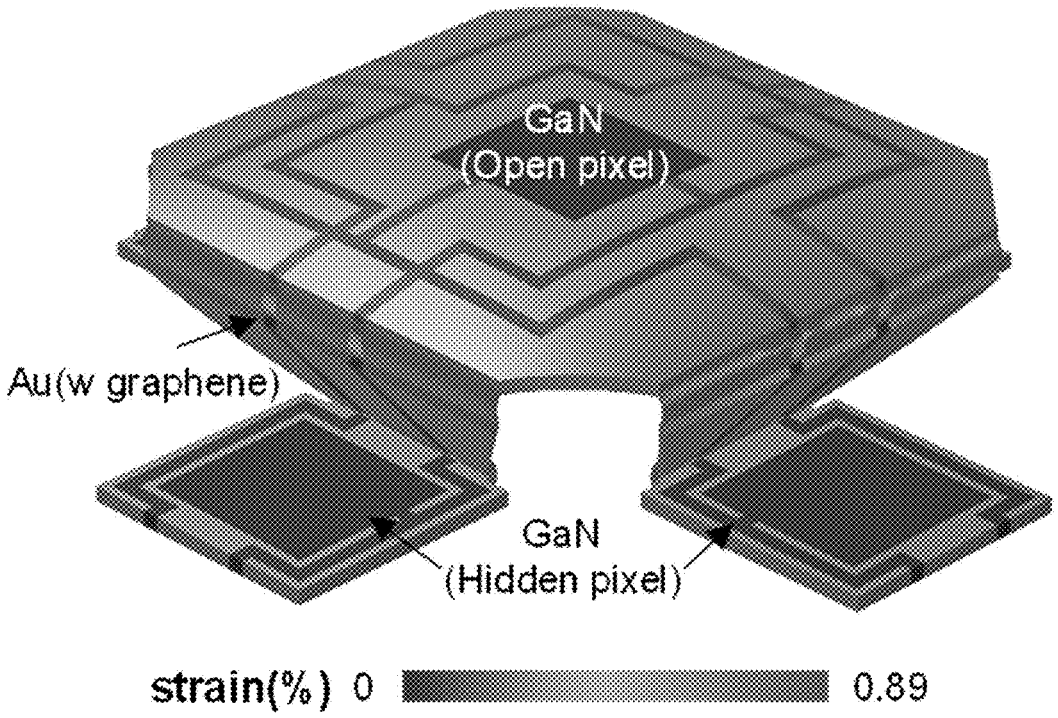
FIGS. 15 to 18 are views illustrating a mechanical characteristic during a folding process of a stretchable display according to another exemplary embodiment of the present disclosure.
Figure 16:
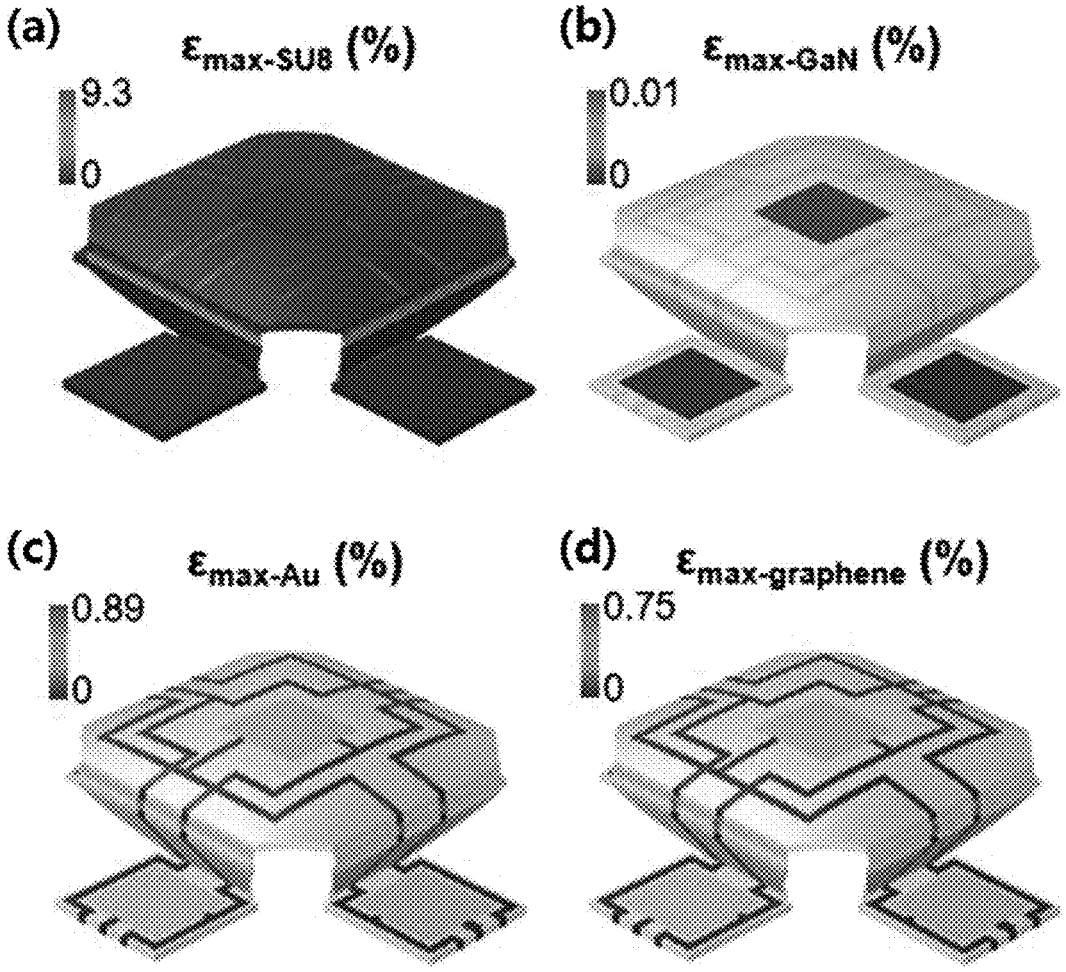
Figure 17:
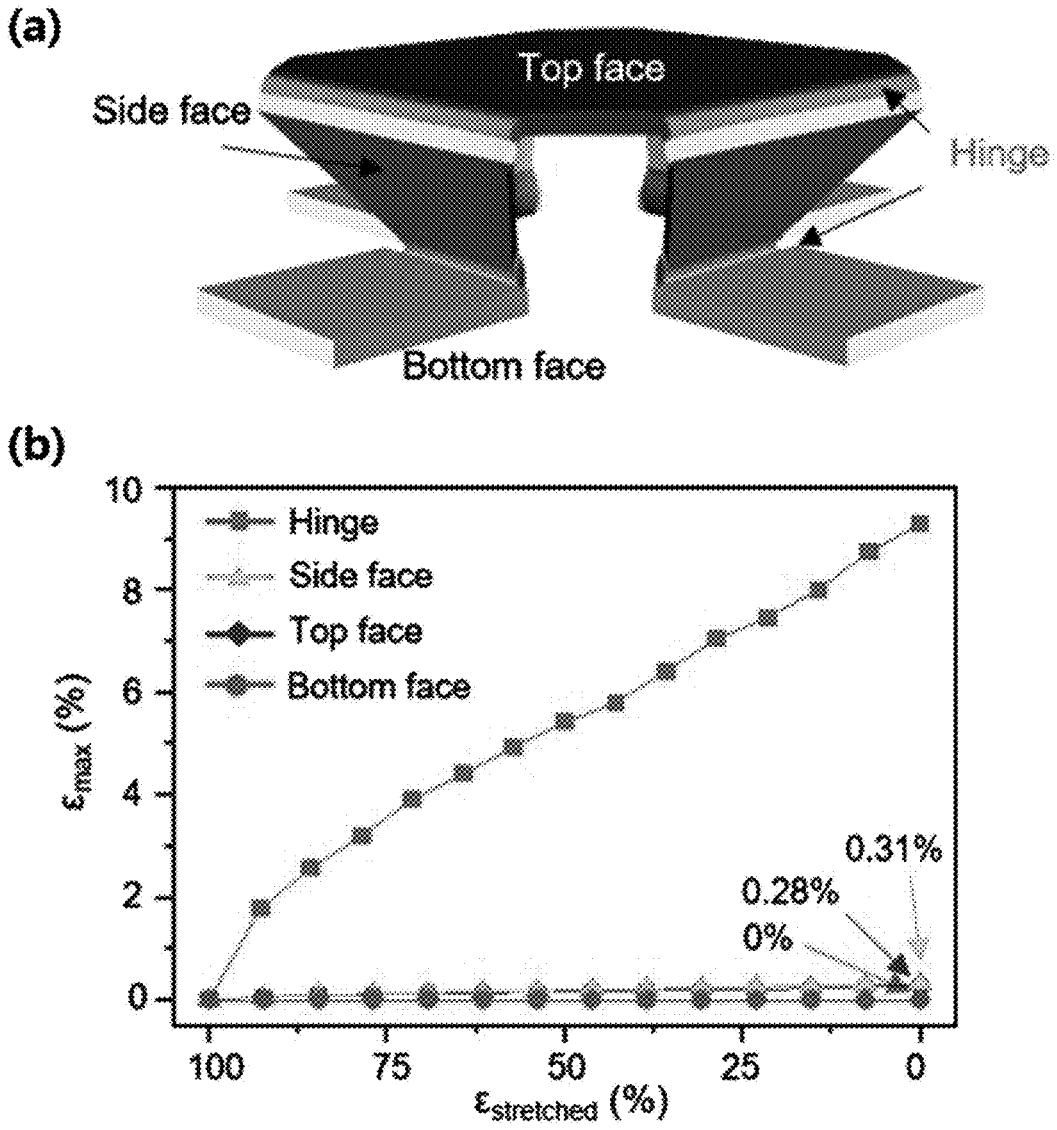
Figure 18:
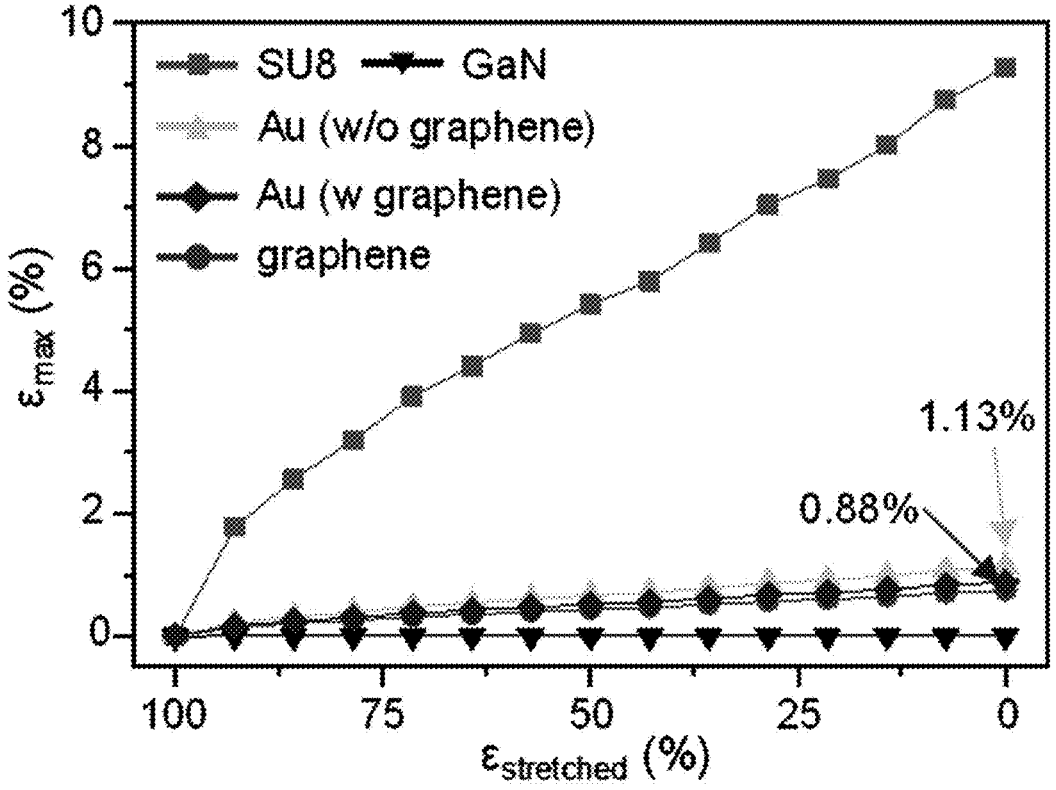

FIGS. 11 and 12 are views illustrating a two-stage structure of a stretchable display according to another exemplary embodiment of the present disclosure. FIGS. 13 and 14 are views illustrating a three-stage structure of a stretchable display according to another exemplary embodiment of the present disclosure;

As seen from the cross-section of the structure, one or more folded parts are provided and a zigzag pattern, such as "Z", "N", "M", "W", is formed. A layered structure having a plurality of stages, such as a two-stage layered structure (one-stage folded structure) and a three-stage layered structure (two-stage folded structure) may be formed. Two-stage layered structure may be converted into the first display mode or the second display mode and the three-stage layered structure may be converted into the first display mode, the second display mode, or a third display mode.

Hidden pixels are disposed on a bottom part or a folded part of the three-dimensional structure and initial pixels (open pixels) are disposed on an upper surface of the three-dimensional structure. The open pixels are driven in the three-dimensional folded structure including a "z" folding in an initial state before stretching and the open pixel and the hidden pixel are simultaneously driven in the flat structure state after stretching to maintain the same resolution state per unit area before and after stretching.

The stretchable display activates the hidden pixels as much as a ratio of the increased area in the first display mode from the second display mode to adjust a resolution per unit area.

For example, 4×4 open pixels are activated in the second display mode (a folded mode) and 7×7 pixels are activated in the first display mode (a stretched mode). The 7×7 pixels are divided into 3+7+3+7+3+7+3 hidden pixels between the 4×4 open pixels. 3+4+3+4+3+4+3 hidden pixels located in a joint part between the cross connection structures are located in the middle of the horizontal/vertical spaces of the open pixels. 3×3 hidden pixels located in the donut blank structure to which the wiring path passes are located in the middle in the diagonal space of the open pixels. One pixel may be disposed in the middle of the spaces or a plurality of hidden pixels is disposed with a constant distance in the length of the space.

In the case of the three stage layered structure, the stretchable display is converted between the first display mode (stretched mode), the second display mode (intermediate mode), and the third display mode (folded mode). The three stage layered structure is considered as an expanding version of the two stage layered structure. The stretchable display may be expanded to four or more stages of layered structure having a plurality of intermediate modes.

The substrate is divided into (i) an open area (a roof area) which is exposed in the first display mode, the second display mode, and the third display mode, (ii) a second hidden area (a lower leg area) which is exposed in the first display mode (stretched mode) and the second display mode (intermediate mode), and (iii) a first hidden area (an intermediate leg area) which is exposed only in the first display mode (stretched mode).

Figure 19:
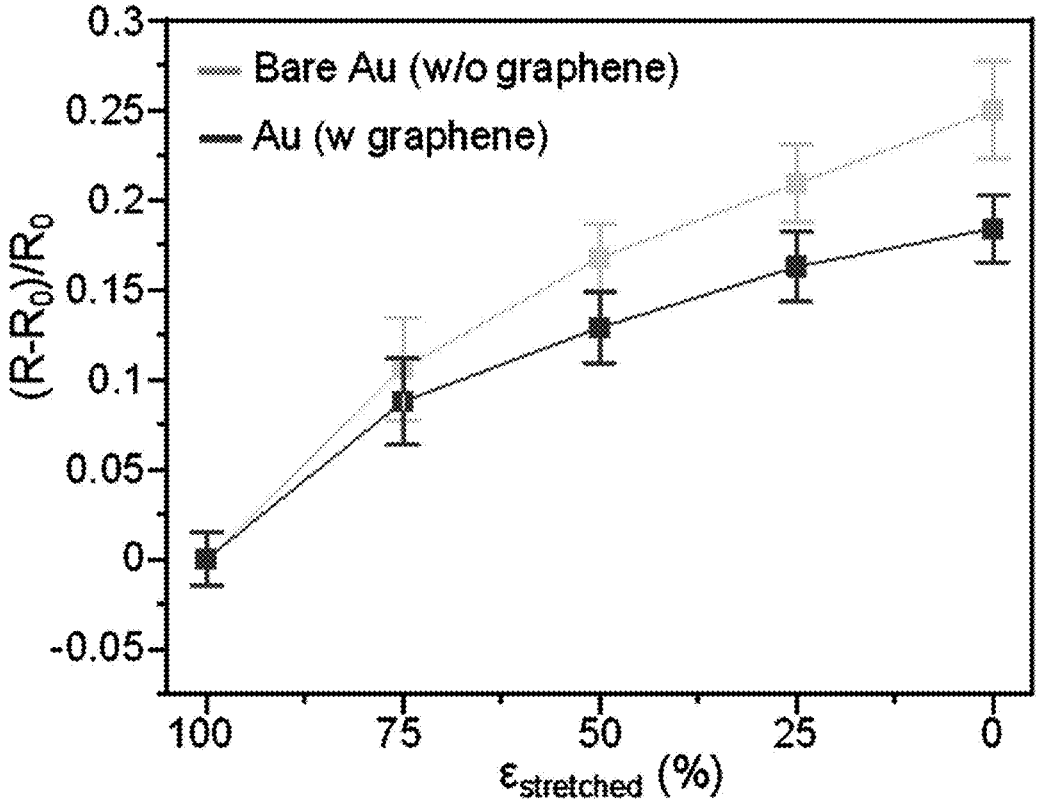
FIG. 19 is a view illustrating an electrical characteristic during a folding process of a stretchable display according to another exemplary embodiment of the present disclosure.
Figure 20:
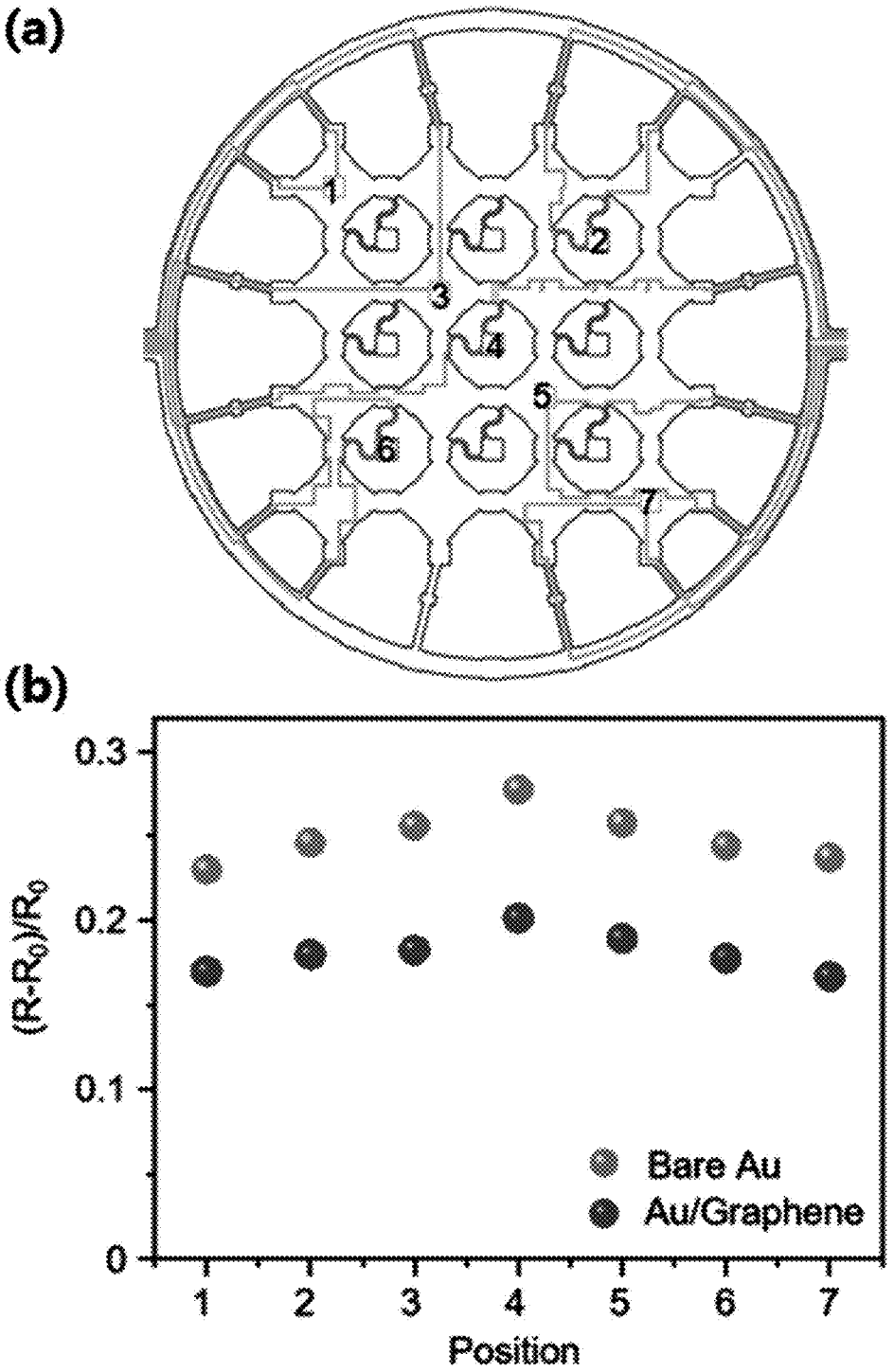
FIG. 20 is a view illustrating an electrical characteristic for every placement position in a folded state of a stretchable display according to another exemplary embodiment of the present disclosure.
Figure 21:
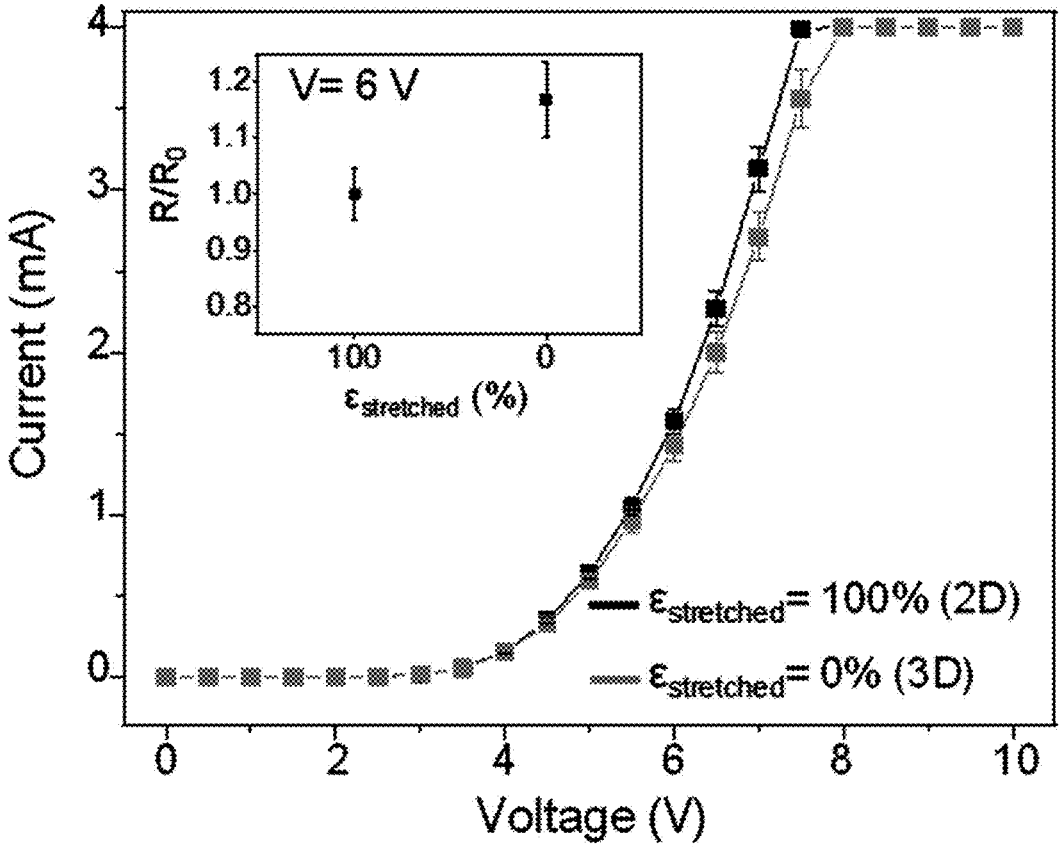
FIGS. 21 and 22 are views illustrating an electrical characteristic when a structure of a stretchable display according to another exemplary embodiment of the present disclosure is changed.
Figure 22:
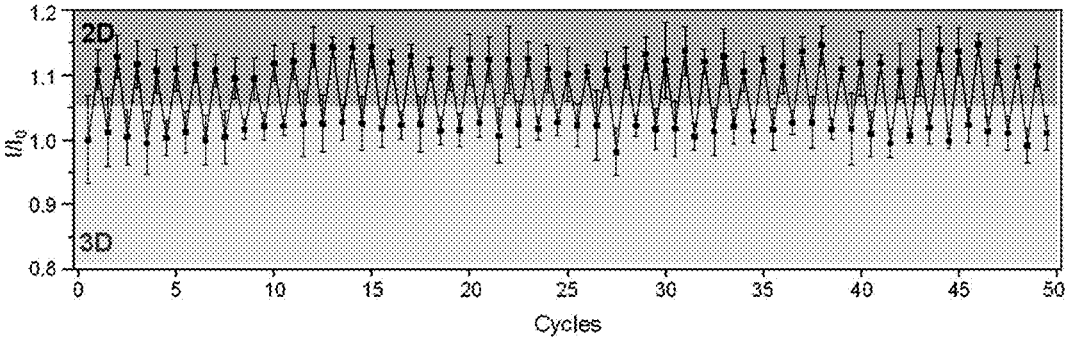
Figure 23:
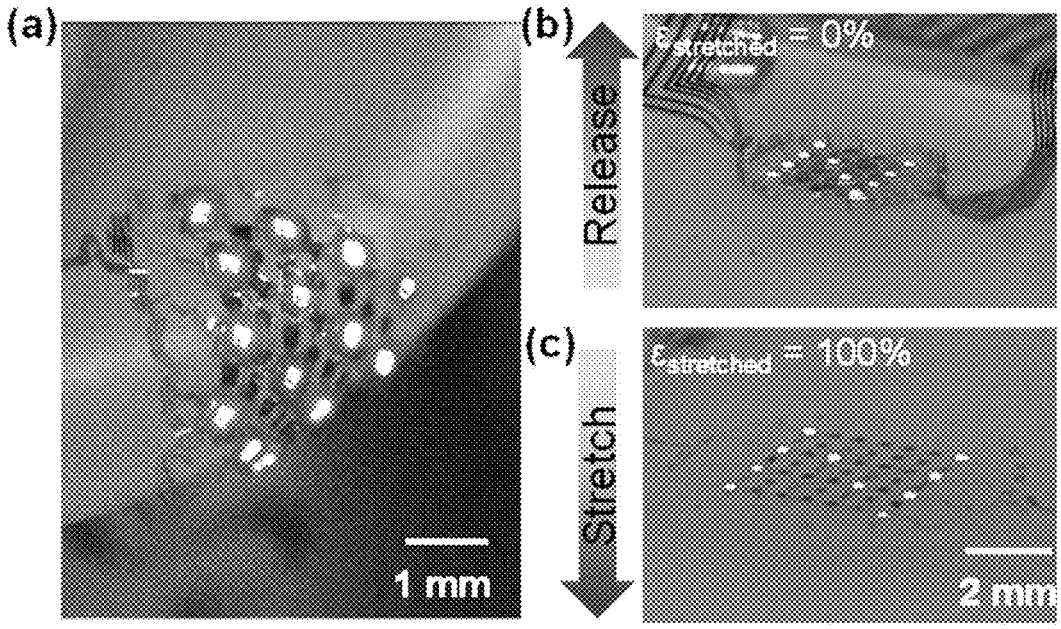
FIGS. 23 to 26 are views illustrating an optical characteristic when a structure of a folding process of a stretchable display according to another exemplary embodiment of the present disclosure is changed.
Figure 24:
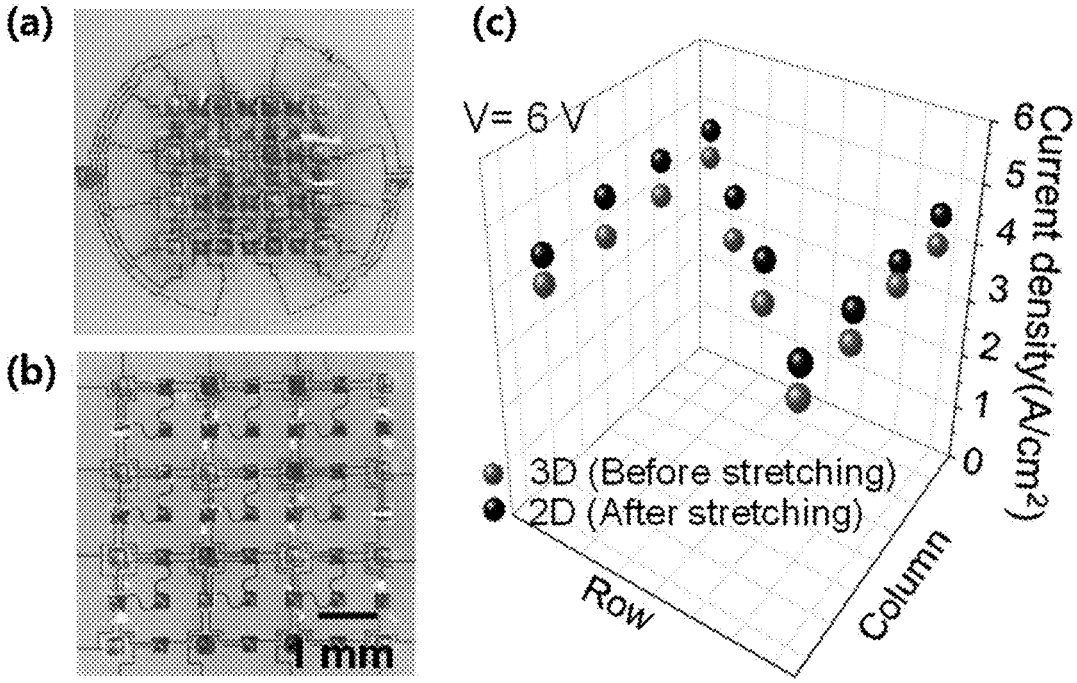
Figure 25:
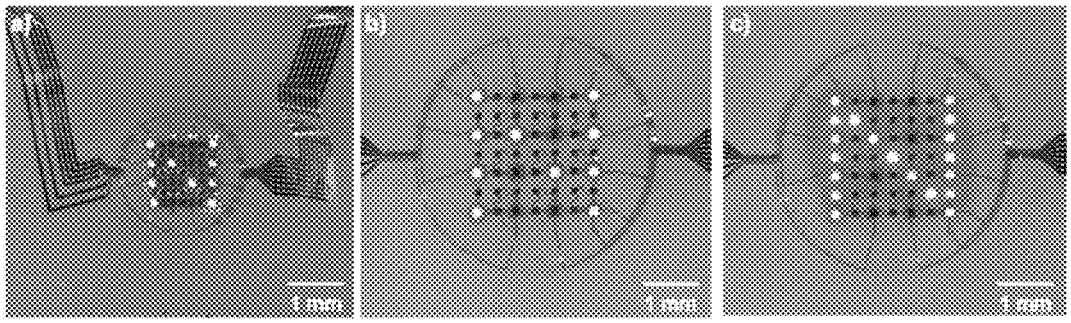
Figure 26:
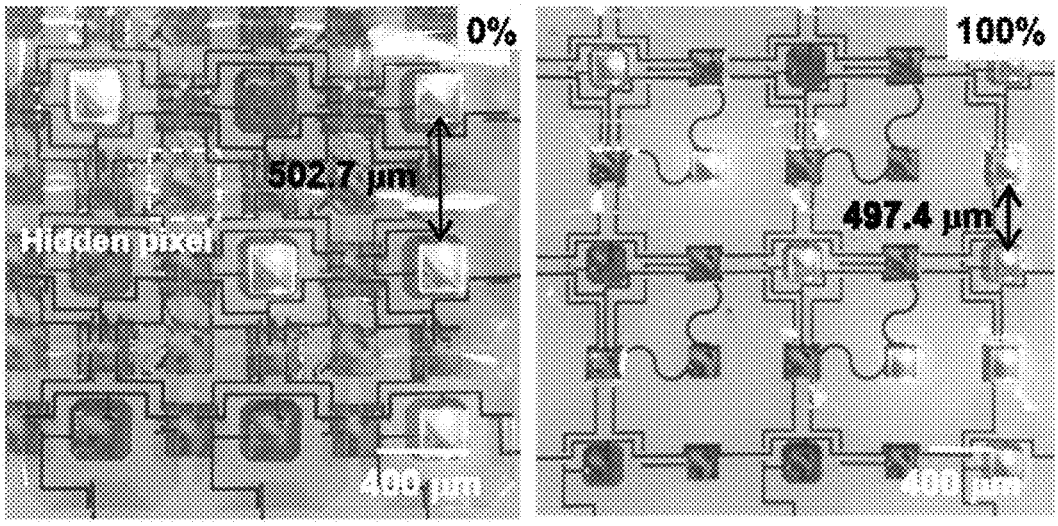

FIGS. 15 to 18 are views illustrating a mechanical characteristic during a folding process of a stretchable display according to another exemplary embodiment of the present disclosure. FIG. 19 is a view illustrating an electrical characteristic during a folding process of a stretchable display according to another exemplary embodiment of the present disclosure. FIG. 20 is a view illustrating an electrical characteristic for every placement position in a folded state of a stretchable display according to another exemplary embodiment of the present disclosure. FIGS. 21 and 22 are views illustrating an electrical characteristic when a structure of a stretchable display according to another exemplary embodiment of the present disclosure is changed. FIGS. 23 to 26 are views illustrating an optical characteristic when a structure of a folding process of a stretchable display according to another exemplary embodiment of the present disclosure is changed.

It is confirmed that the stretchable display according to the present exemplary embodiment has strong mechanical, electrical, and optical characteristics even in the folded structure using metal/graphene.

Figure 27:
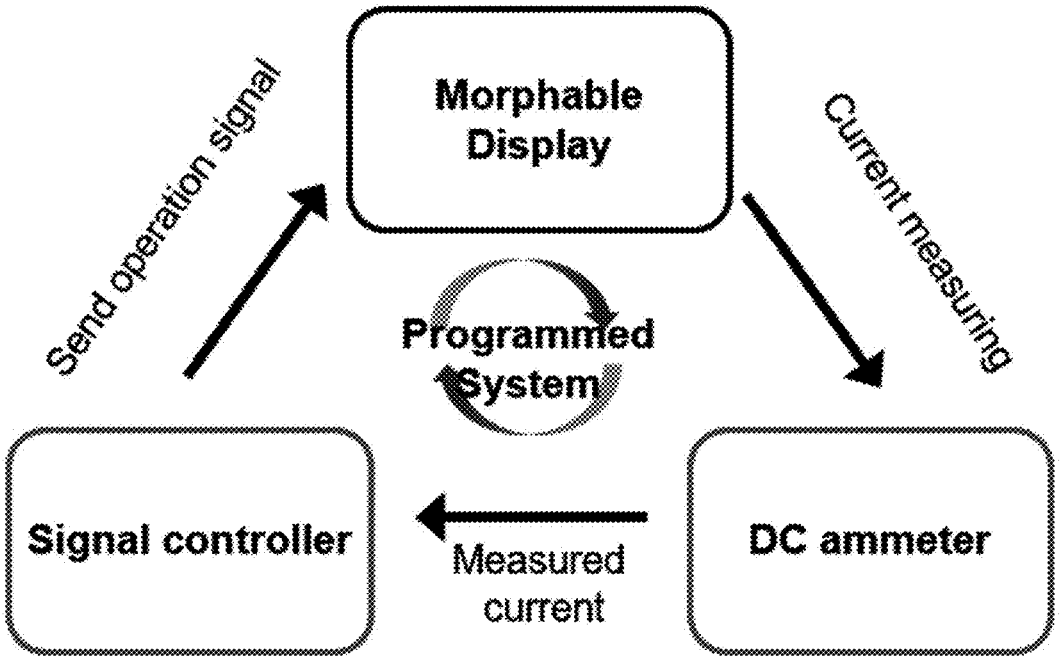
FIG. 27 is a view illustrating a method that a stretchable display according to another exemplary embodiment of the present disclosure changes a mode.
Figure 28:
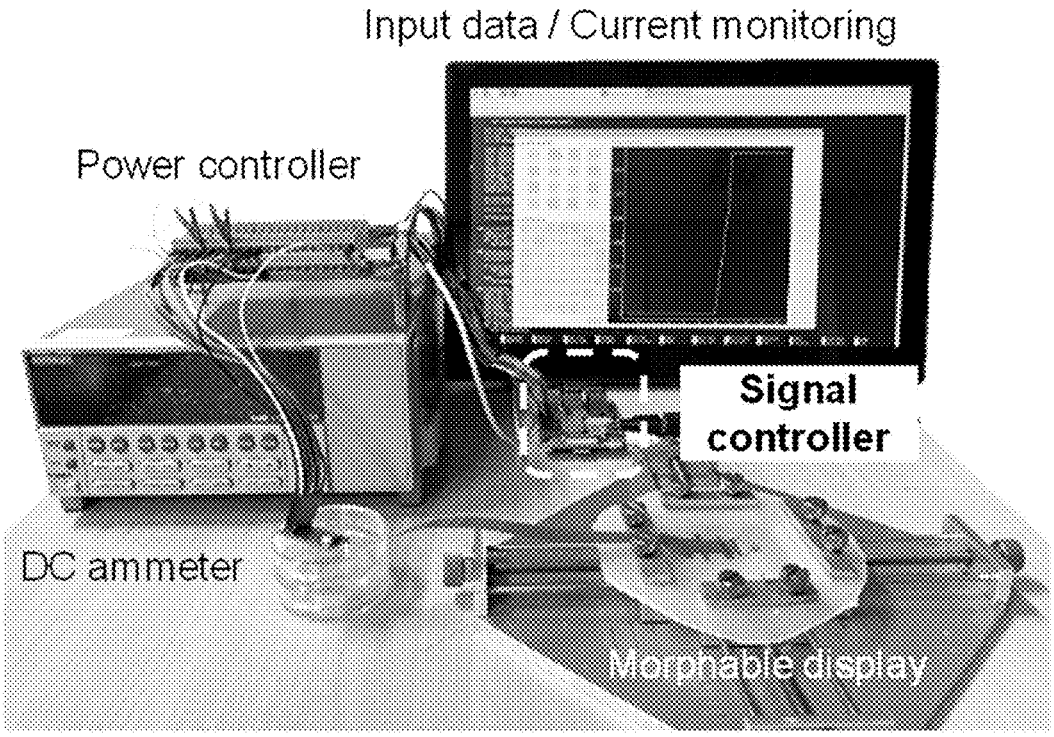
FIG. 28 is a view illustrating a feedback system of a stretchable display according to another exemplary embodiment of the present disclosure.
Figure 29:
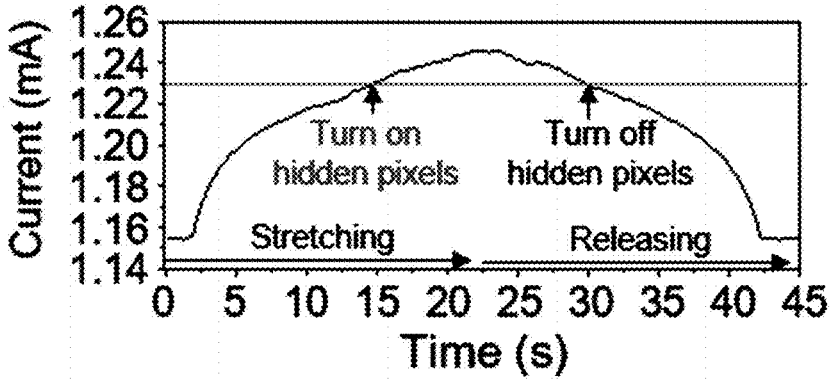
FIG. 29 is a view illustrating a current change when a structure of a stretchable display according to another exemplary embodiment of the present disclosure is changed.

FIG. 27 is a view illustrating a method that a stretchable display according to another exemplary embodiment of the present disclosure changes a mode. FIG. 28 is a view illustrating a feedback system of a stretchable display according to another exemplary embodiment of the present disclosure. FIG. 29 is a view illustrating a current change of a stretchable display according to another exemplary embodiment of the present disclosure.

The stretchable display designates to turn on or off the hidden pixel using a difference in the current measured in the three-dimensional folded structure and the two-dimensional flat structure. In the three-dimensional stage, a strain is applied to the electrode part to increase the resistance so that the current is low and in the two-dimensional structure, the strain is reduced so that the resistance is low and the current is high. By using this, an automation system which detects the change of the shape and turns on or off the hidden pixel is constructed.

The current measuring unit measures a first current value using a wiring electrode in a flat structure state of the first display mode. The current measuring unit measures a second current value using a wiring electrode in a folded structure state of the second display mode.

The controller transmits an operation control signal generated based on a result of comparing the first current value and a reference value or comparing the second current value and the reference current value to the hidden pixel. The hidden pixel may be turned on or off according to the operation control signal.

The controller transmits (i) a first on-off control signal generated based on the result of comparing the first current value and the reference current value, (ii) a second on-off control signal generated based on the result of comparing the second current value and the reference current value, or a third on-off control signal which is a combination of the first on-off control signal and the second on-off control signal to the hidden pixel. The hidden pixel may be turned on or turned off according to the first on-off control signal, the second on-off control signal, or the third on-off control signal.

The reference current value may apply an experimentally appropriate value depending on a design and a plurality of intervals may be applied. A first reference current value to be compared with the first current value and a second reference current value to be compared with the second current value may be set.

The control unit may transmit the signal to the hidden pixel directly or via the wiring electrode. The operation control signal may be a turn-on signal or a turn-off signal.

Figure 30:
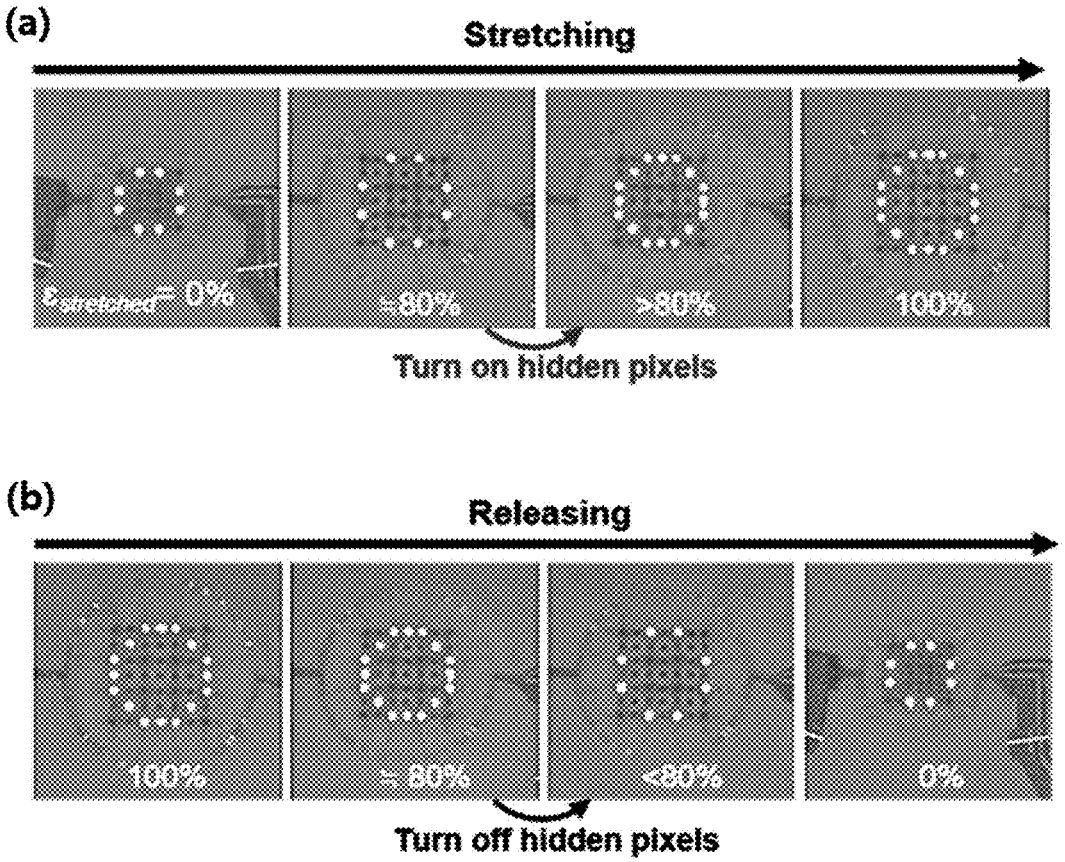
FIG. 30 is a view illustrating an operation of a hidden pixel in a first display mode and a second display mode of a stretchable display according to another exemplary embodiment of the present disclosure.

FIG. 30 is a view illustrating an operation of a hidden pixel in a first display mode and a second display mode of a stretchable display according to another exemplary embodiment of the present disclosure.

Referring to FIG. 30 which illustrates a two stage layered structure, it is confirmed that a resolution of the three-dimensional stretchable display is adjusted by the hidden pixel driving feedback method using an electrode current change according to the structure change of the display. The hidden pixel may be located and activated in the middle of the horizontal/vertical space of the open pixels according to the structure change of the display. The hidden pixel may be located and activated in the middle of the diagonal space of the open pixels according to the structure change of the display.

For example, in the three stage layered structure, the substrate may be divided into (i) an open area which is exposed in the first display mode, the second display mode, and the third display mode, (ii) a second hidden area which is exposed in the first display mode and the second display mode, and (iii) a first hidden area which is exposed only in the first display mode.

The pixel array includes an open pixel located in the open area, a first hidden pixel located in the first hidden area, and a second hidden pixel located in the second hidden area. The open pixel is activated in the first display mode, the second display mode, or the third display mode, the first hidden pixel is activated only in the first display mode, and the second hidden pixel is activated in the first display mode or the second display mode.

Figure 31:
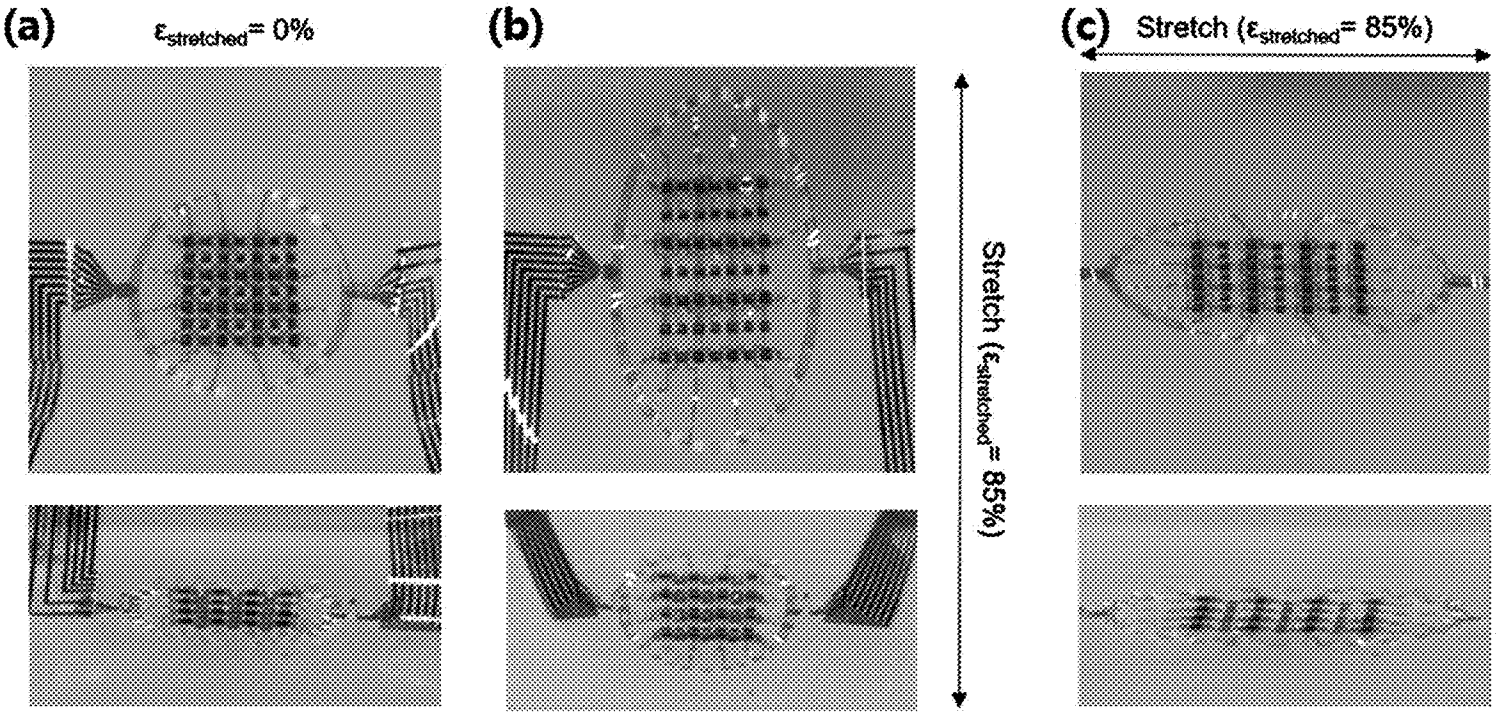
FIG. 31 is a view illustrating that a structure is changed in a plurality of axial directions in a pixel-off state of a stretchable display according to another exemplary embodiment of the present disclosure.
Figure 32:
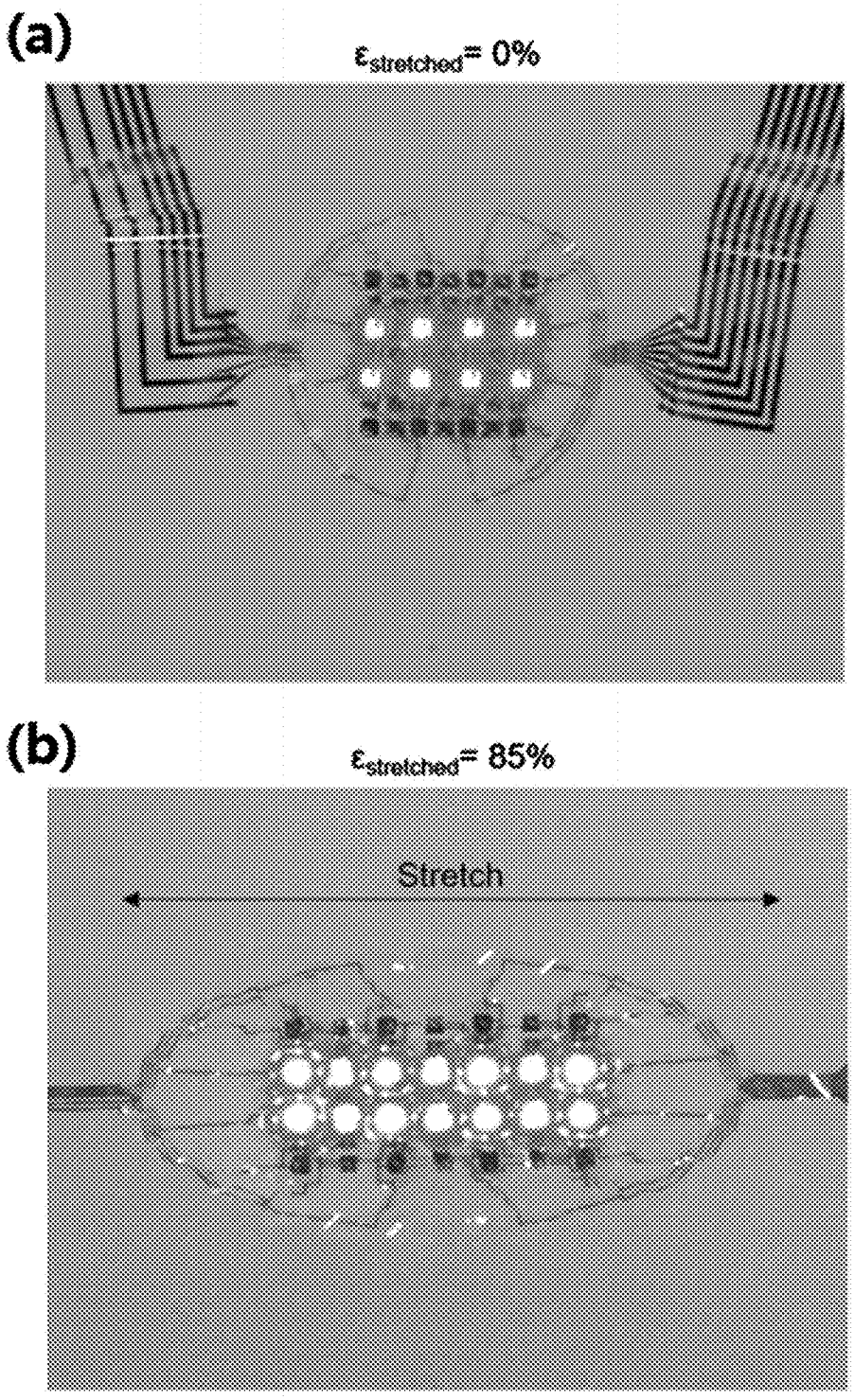
FIG. 32 is a view illustrating that a structure is changed in one axial direction in a pixel-on state of a stretchable display according to another exemplary embodiment of the present disclosure.
Figure 33:
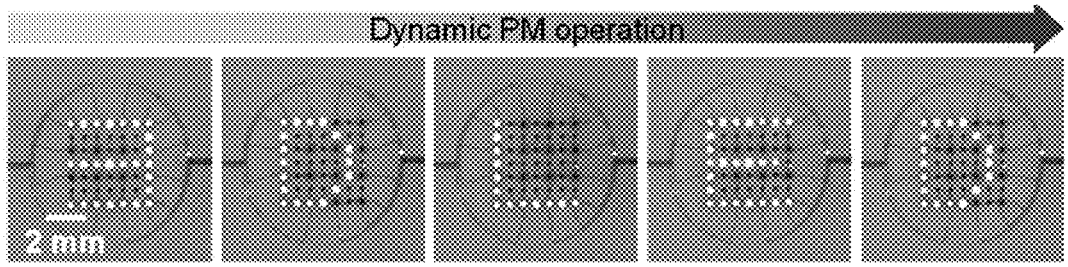
FIG. 33 is a view illustrating a combination of various on/off states of a pixel of a stretchable display according to another exemplary embodiment of the present disclosure.

FIG. 31 is a view illustrating that a structure is changed in a plurality of axial directions in a pixel-off state of a stretchable display according to another exemplary embodiment of the present disclosure, FIG. 32 is a view illustrating that a structure is changed in one axial direction in a pixel-on state of a stretchable display according to another exemplary embodiment of the present disclosure, and FIG. 33 is a view illustrating a combination of various on/off states of a pixel of a stretchable display according to another exemplary embodiment of the present disclosure.

The display according to the present exemplary embodiment may adjust a resolution property of the display while ensuring the stretchability. The property allows the display to be utilized in the field of wearable display which requires the stretchability.

A plurality of components included in an electronic device to which the stretchable display is applied is combined to each other to be implemented as at least one module. The components are connected to a communication path which connects a software module or a hardware module in the apparatus to organically operate between the components. The components communicate with each other using one or more communication buses or signal lines.

The electronic device to which the stretchable display is applied may be implemented in a logic circuit by hardware, firm ware, software, or a combination thereof or may be implemented using a general purpose or special purpose computer. The device may be implemented using hardwired device, field programmable gate array (FPGA) or application specific integrated circuit (ASIC). Further, the device may be implemented by a system on chip (SoC) including one or more processors and a controller.

The electronic device to which the stretchable display is applied may be mounted in a computing device provided with a hardware element as a software, a hardware, or a combination thereof. The computing device may refer to various devices including all or some of a communication device for communicating with various devices and wired/wireless communication networks such as a communication modem, a memory which stores data for executing programs, and a microprocessor which executes programs to perform operations and commands.

In FIGS. 1 to 4, the respective processes are sequentially performed, but this is merely illustrative and those skilled in the art may apply various modifications and changes by changing the order illustrated in FIGS. 1 to 4 or performing one or more processes in parallel or adding another process without departing from the essential gist of the exemplary embodiment of the present disclosure.

The present embodiments are provided to explain the technical spirit of the present embodiment and the scope of the technical spirit of the present embodiment is not limited by these embodiments. The protection scope of the present embodiments should be interpreted based on the following appended claims and it should be appreciated that all technical spirits included within a range equivalent thereto are included in the protection scope of the present embodiments.

What is claimed is:

1. A stretchable display which operates in a first display mode or a second display mode, comprising:

a substrate which is patterned according to a foldable design and has a pixel array disposed thereon;

a wiring electrode connected to the pixel array;

a protecting unit which includes a carbon polymer compound formed on the wiring electrode;

a black matrix which is formed in the protecting unit and processes light;

a groove or a hinge which is formed in the black matrix and has a part folded in the second display mode thinner than a part which is not folded; and an elastomer attached to the substrate, wherein the stretchable display is a flat structure state in the first display mode and is a folded structure state in the second display mode, and wherein the substrate includes a donut blank structure and a cross connection structure through which a wiring path passes in a polygonal shape, a circular shape, or a combination thereof according to the design and the substrate is divided into (i) an open area which is exposed in the first display mode or the second display mode and (ii) a hidden area exposed only in the first display mode.

2. The stretchable display according to claim 1, wherein the pixel array includes an open pixel located in the open area and includes a hidden pixel located in the hidden area, and the open pixel is activated in the first display mode or the second display mode, and the hidden pixel is activated only in the first display mode.

3. The stretchable display according to claim 2, wherein the stretchable display activates the hidden pixels as much as a ratio of the increased area in the first display mode from the second display mode to adjust a resolution per unit area.

4. The stretchable display according to claim 2, further comprising:

a current measuring unit which measures a first current value through the wiring electrode in the flat structure state of the first display mode and measures a second current value measured through the wiring electrode in the folded structure state of the second display mode.

5. The stretchable display according to claim 4, further comprising:

a controller which transmits (i) a first on-off control signal generated based on a result of comparing the first current value and the reference current value, (ii) a second on-off control signal generated based on a result of comparing the second current value and the reference current value, or a third on-off control signal which is a combination of the first on-off control signal and the second on-off control signal to the hidden pixel.

6. The stretchable display according to claim 5, wherein the hidden pixel is turned on or turned off according to the first on-off control signal, the second on-off control signal, or the third on-off control signal.

7. The stretchable display according to claim, 1 wherein the stretchable display is changed between the first display mode, the second display mode, and the third display mode and the substrate is divided into (i) an open area which is exposed in the first display mode, the second display mode, and the third display mode, (ii) a second hidden area which is exposed in the first display mode and the second display mode, and (iii) a first hidden area which is exposed only in the first display mode.

8. The stretchable display according to claim 7, wherein the pixel array includes an open pixel located in the open area, a first hidden pixel located in the first hidden area, and a second hidden pixel located in the second hidden area, the open pixel is activated in the first display mode, the second display mode, or the third display mode, the first hidden pixel is activated only in the first display mode, and the second hidden pixel is activated in the first display mode or the second display mode.

9. A manufacturing method of a stretchable display manufacturing method comprising:

preparing a substrate on which a pixel array is disposed;

forming a flat structure which operates in a first display mode by patterning the substrate on which the pixel array is disposed according to a foldable design and connecting a wiring electrode, wherein the foldable design includes a donut blank structure and a cross connection structure through which a wiring path passes in a polygonal shape, a circular shape, or a combination thereof and the substrate is divided into an open area and a hidden area; and forming a folded structure operating in a second display mode by attaching an elastomer to the flat structure.

10. The manufacturing method according to claim 9, wherein the forming of a flat structure includes:

connecting the wiring electrode to the pixel array.

11. The manufacturing method according to claim 10, wherein the forming of a flat structure includes:

forming a protecting unit including a carbon polymer compound in the wiring electrode.

12. The manufacturing method according to claim 11, wherein the forming of a flat structure includes:

forming a black matrix which treats light on the protecting unit.

13. The manufacturing method according to claim 12, wherein the forming of a flat structure includes:

forming a groove or a hinge in which a folded portion in the second display mode is formed to be thinner than the unfolded portion, in the black matrix.

14. The manufacturing method according to claim 13, wherein the forming of a flat structure includes:

forming a contact prevention unit so as not to be attached to the elastomer, in the groove or hinge.

15. The manufacturing method according to claim 14, wherein the forming of a folded structure includes:

attaching a water soluble tape to a flat structure including the contact prevention unit; and subjecting a ultraviolet ozone (UVO) treatment to a surface of the flat structure and a surface of the elastomer.

16. The manufacturing method according to claim 15, wherein the forming of a folded structure includes:

stretching a surface-treated elastomer to a predetermined size; and forming a sandwich structure in which the flat structure is located between the water soluble tape and the elastomer, by attaching the stretched elastomer to the surface-treated flat structure.

17. The manufacturing method according to claim 16, wherein the forming of a folded structure includes:

removing the water soluble tape and removing the contact prevention unit; and changing the flat structure to the folded structure by contacting the stretched elastomer to an original size.

* * * * *